US007841905B2

(12) United States Patent
Zheng et al.

(10) Patent No.: US 7,841,905 B2
(45) Date of Patent: Nov. 30, 2010

(54) ELECTRICAL CONNECTOR WITH IMPROVED CONTACT ARRANGEMENT

(75) Inventors: Qi-Sheng Zheng, Kunshan (CN); Hao Gu, Kunshan (CN); Jia-Yong He, Kunshan (CN); Yu-Long Mao, Kunshan (CN); Feng Qiao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/825,342

(22) Filed: Jun. 29, 2010

(65) Prior Publication Data

US 2010/0261385 A1 Oct. 14, 2010

Related U.S. Application Data

(62) Division of application No. 12/228,388, filed on Aug. 11, 2008, now Pat. No. 7,744,426.

(51) Int. Cl.
*H01R 24/00* (2006.01)

(52) U.S. Cl. ..... 439/660

(58) Field of Classification Search ..... 439/660, 439/607.04, 607.35, 607.39
See application file for complete search history.

(56) References Cited

U.S. PATENT DOCUMENTS 5,975,954 A * 11/1999 Wu et al. ..... 439/607.35
7,021,971 B2 4/2006 Chou et al.
7,104,848 B1 9/2006 Chou et al.
7,108,560 B1 9/2006 Chou et al.
7,134,884 B2 11/2006 Wang et al.
7,686,656 B2 * 3/2010 Zheng et al. ..... 439/660
7,744,382 B2 * 6/2010 Zheng et al. ..... 439/79
7,744,418 B2 * 6/2010 He et al. ..... 439/607.35
7,744,426 B2 * 6/2010 Zheng et al. ..... 439/660
2010/0093222 A1 * 4/2010 He et al. ..... 439/638
2010/0173529 A1 * 7/2010 He et al. ..... 439/660

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector for being mounted on a PCB, has a receiving space (10) and includes an insulative housing (1) having a tongue portion (12) being parallel to the PCB, the tongue portion having a mating face (14), a set of depressions (141) formed in a front region of the mating face, and a set of passageways (142) formed in a rear region of the mating face; and a set of contacts including a set of first and second contacts (21,22). The first contacts have elastic first contact portions (15) being movably received in the passageways, first tail portions (16), and first connecting portions (17) extending along the tongue portion. The second contacts have stiff second contact portions (25) received in the depressions, second tail portions (28), and second connecting portions (27) being parallel to the first connecting portions in a height direction of the tongue portion. The second contact portions (27) are located at an inner side of the mating face (14).

9 Claims, 36 Drawing Sheets

ELECTRICAL CONNECTOR WITH IMPROVED CONTACT ARRANGEMENT

This application is a divisional application of application Ser. No. 12/228,388 filed on Aug. 11, 2008 and now issued on Jun. 29, 2010 with a U.S. Pat. No. 7,744,426.

BACKGROUND OF THE INVENTION

1. Field of the Invention

The present invention relates to electrical connectors, more particularly to electrical connectors with additional differential contact pair for transmitting high speed signals and with improved contact arrangement.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

FIGS. 49 and 50 show existing USB connectors. In FIG. 49, this USB connector 50 is an existing USB plug, male connector. In application, the USB plug 50 may be mounted on a board in the peripherals, or may be connected to wires of a cable 57 as shown in FIG. 49. Generally, an insulative outer housing 55 always be molded over a rear end of the USB plug 50 and the cable 57 to secure the USB plug 50, the cable 57 and the insulative outer housing 55 together. The USB plug 50 can also be mounted in an opening in a plastic case of a peripheral, like a portable memory device. The USB plug 50 represents a type-A 2.0 USB connector. The USB plug 50 includes an insulative plug tongue portion 52 formed of an insulating material, four conductive contacts 53 held on the insulative plug tongue portion 52 and an metal shell 54 enclosing the conductive contacts 53 and the insulative plug tongue portion 52. The metal shell 54 touches the insulative plug tongue portion 52 on three of the sides of the plug tongue portion 52 except a top side thereof. The conductive contacts 53 are supported on the top side of the plug tongue portion 52. A receiving cavity 56 is formed between the top side of the plug tongue portion 52 and a top face 541 of the metal shell 54 for receiving a corresponding insulative receptacle tongue portion 62 shown in FIG. 50. The conductive contacts 53 carry the USB signals generated or received by a controller chip in the peripherals.

USB signals typically include power, ground (GND), and serial differential data D+, D−. To facilitate discussion, the four conductive contacts 53 of the USB plug 50 are designated with numeral 531, 532, 533 and 534 in turn as shown in FIG. 49. In application, the four conductive contacts 531, 532, 533 and 534 are used to transfer power, D−, D+ and ground signals, respectively. The two central conductive contacts 532, 533 are used to transfer/receive data to/from the peripheral device or a host device. The four conductive contacts 531, 532, 533 and 534 can be formed of metal sheet in a manner being stamped out therefrom to four separated ones or formed as conductive pads on a printed circuit board (PCB, not shown) supported on the top side of the plug tongue portion 52.

FIG. 50 shows an existing USB receptacle 60, a female USB connector for mating with the existing USB plug 50. The USB receptacle 60 commonly is an integral part of a host or PC. The USB receptacle 60 also presents a type-A USB 2.0 connector. The USB receptacle 60 includes the insulative receptacle tongue portion 62 formed of an insulating material, four conductive contacts 63 held on the insulative receptacle tongue portion 62 and a metal shell 64 shielding the conductive contacts 63 and the insulative receptacle tongue portion 62. The conductive contacts 63 are supported on a bottom surface of the insulative receptacle tongue portion 62. Same to assignment of the four conductive contacts 53 of the USB plug 50, assignment of the four conductive contacts 63 of the USB receptacle 60 is contact 631 for power signal, contact 632 for D− signal, contact 633 for D+ signal and contact 634 for GND. Another receiving cavity 66 is formed between the bottom surface of the insulative receptacle tongue portion 62 and a bottom of the metal shell 64. In application, the USB plug 50 usually disposed in the peripheral device is inserted into the USB receptacle 60 mounted in the host or PC device. The plug tongue portion 52 is received in the receiving cavity 66 of the USB receptacle 60 and the receptacle tongue portion 62 is received in the receiving cavity 56 of the USB plug 50. After full insertion of the USB plug 50, the conductive contacts 531, 532, 533 and 534 of the USB plug 50 make a physical and electrical connection with the conductive contacts 631, 632, 633 and 634 of the USB receptacle 60, respectively, to transmit/receive signal to/from the host device to the peripheral device.

As discussed above, the existing USB connectors have a small size but low transmission rate, while other non-USB connectors (PCI Express, SATA, et al) have a high transmission rate but large size. Neither of them is desirable to implement modern high-speed, miniaturized electronic devices and peripherals. Thus, to provide a kind of connector with a high transmission rate for portability and high data transmitting efficiency, and with reasonable contact arrangement is much desirable.

BRIEF SUMMARY OF THE INVENTION

An electrical connector for being mounted on a PCB, defines a receiving space for receiving a plug and comprises an insulative housing including a tongue portion protruding into the receiving space and being parallel to the PCB, the tongue portion defining a mating face, a plurality of depressions defined in a front region of the mating face, and a plurality of passageways defined in a rear region of the mating face and being spaced away from the depressions; and a plurality of contacts held in the tongue portion and comprising a plurality of first and second contacts. The first contacts have elastic first contact portions being movably received in the passageways and protruding beyond the mating face and into the receiving space, first tail portions for being mounted on the PCB, and first connecting portions located between the first contact portions and the first tail portions and extending along the tongue portion. The second contacts have stiff second contact portions received in the depressions and exposed to the receiving space, second tail portions for being mounted on the PCB, and second connecting portions located between the second contact portions and the second tail portions and being parallel to the first connecting portions in a height direction of the tongue portion. The second contact portions are located at an inner side of the mating face.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
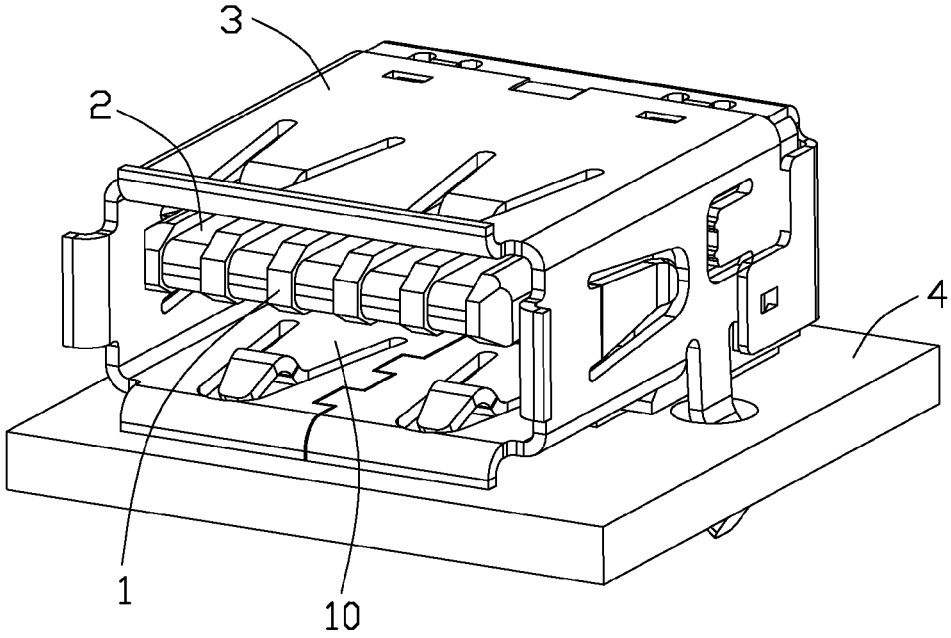
FIG. 1 is a perspective view of an electrical connector mounted on a PCB according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, receptacle, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plugged.

Referring to FIGS. 1-7, an electrical connector 100 mounted on a PCB 4 is disclosed. The electrical connector 100 includes an insulative housing 1, a plurality of contacts 2 held in the insulative housing 1, a metal shell 3 enclosing the insulative housing 1, a rear shell 5 abutting against the metal shell 3 and a spacer 6 for organizing the contacts 2.

Figure 5:
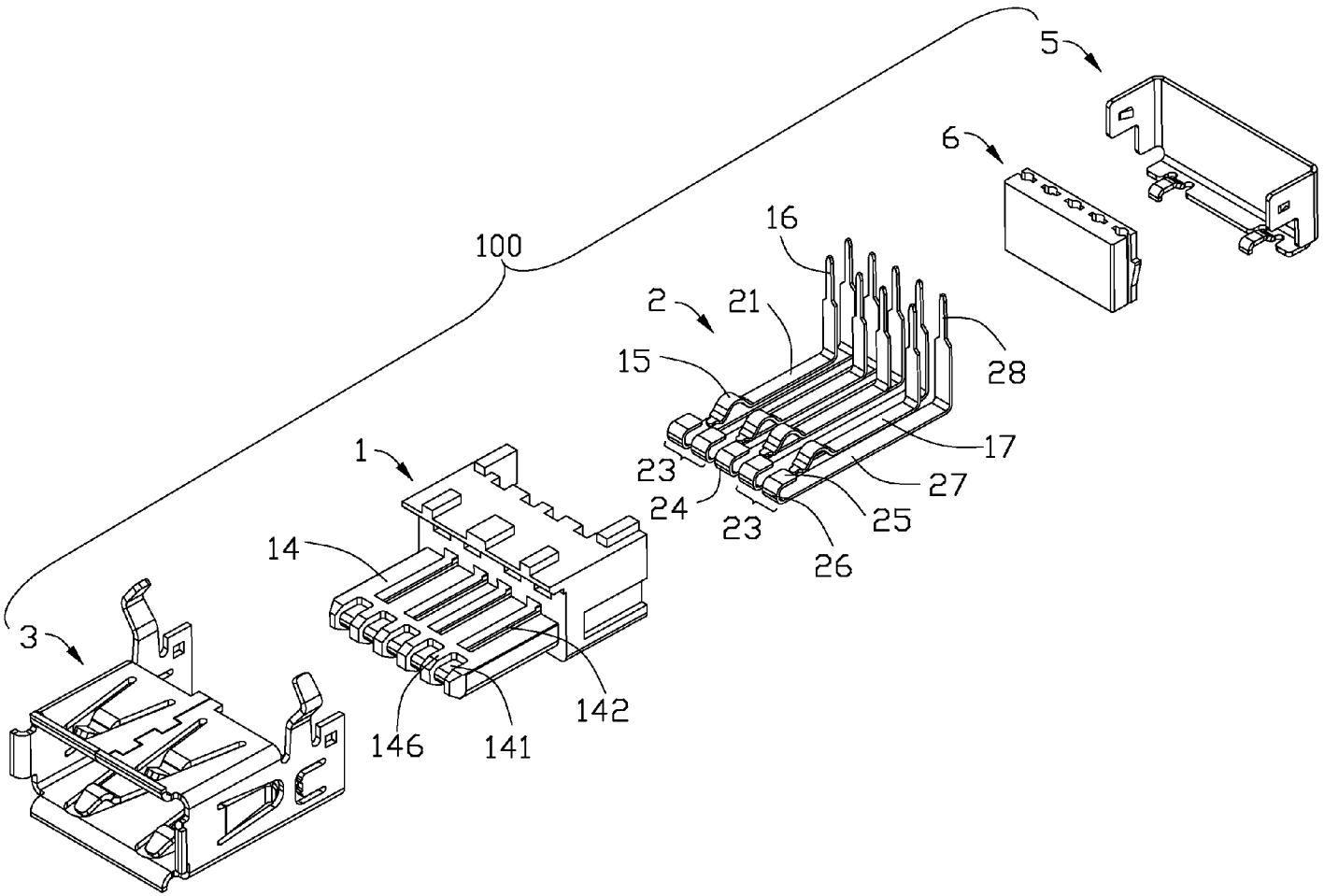
FIG. 5 is another partly exploded view of the electrical connector shown in FIG. 4, but viewed from another aspect.
Figure 6:
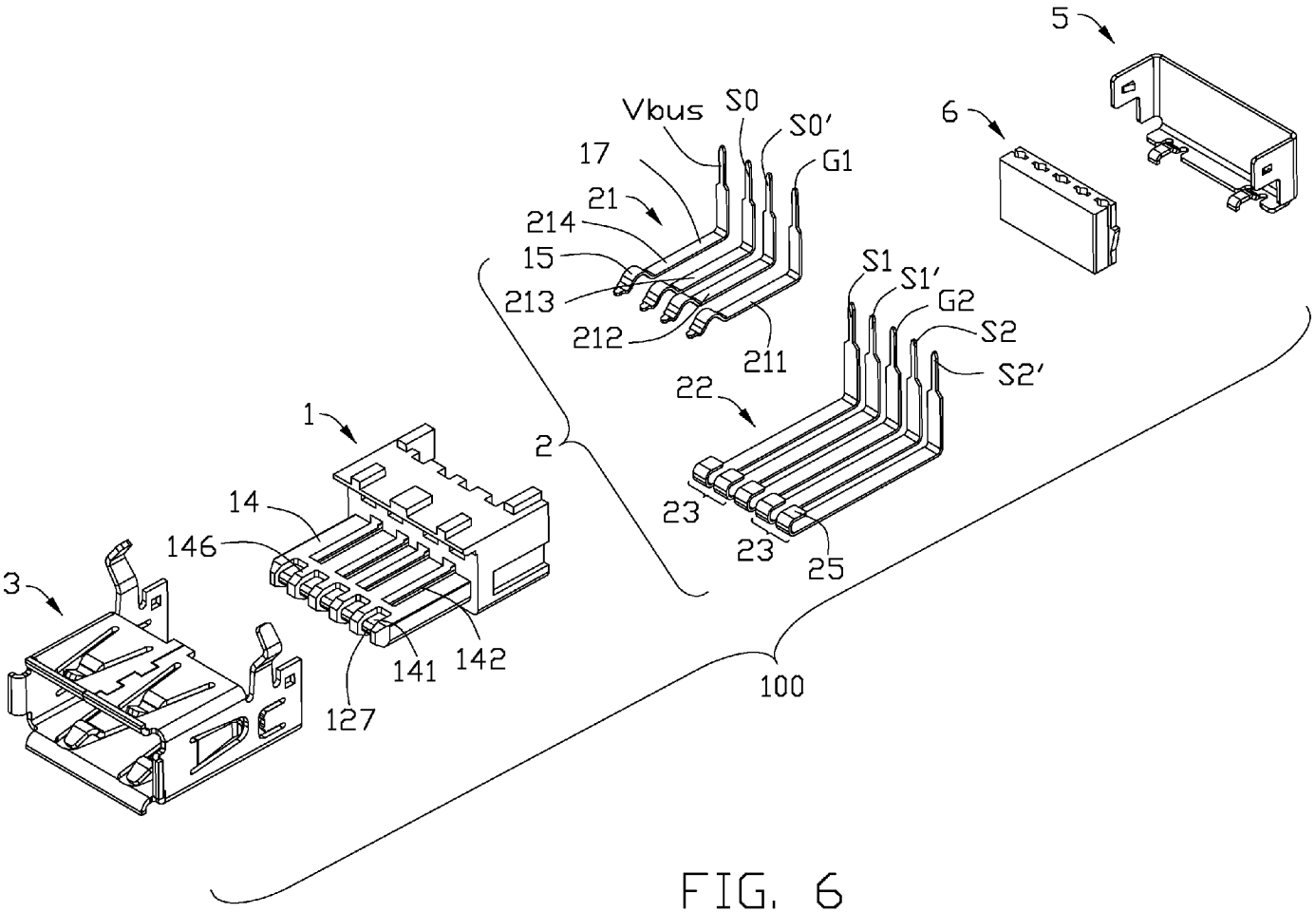
FIG. 6 is an exploded view of the electrical connector shown in FIG. 5 illustrating conductive contacts are separate from additional contacts.
Figure 7:
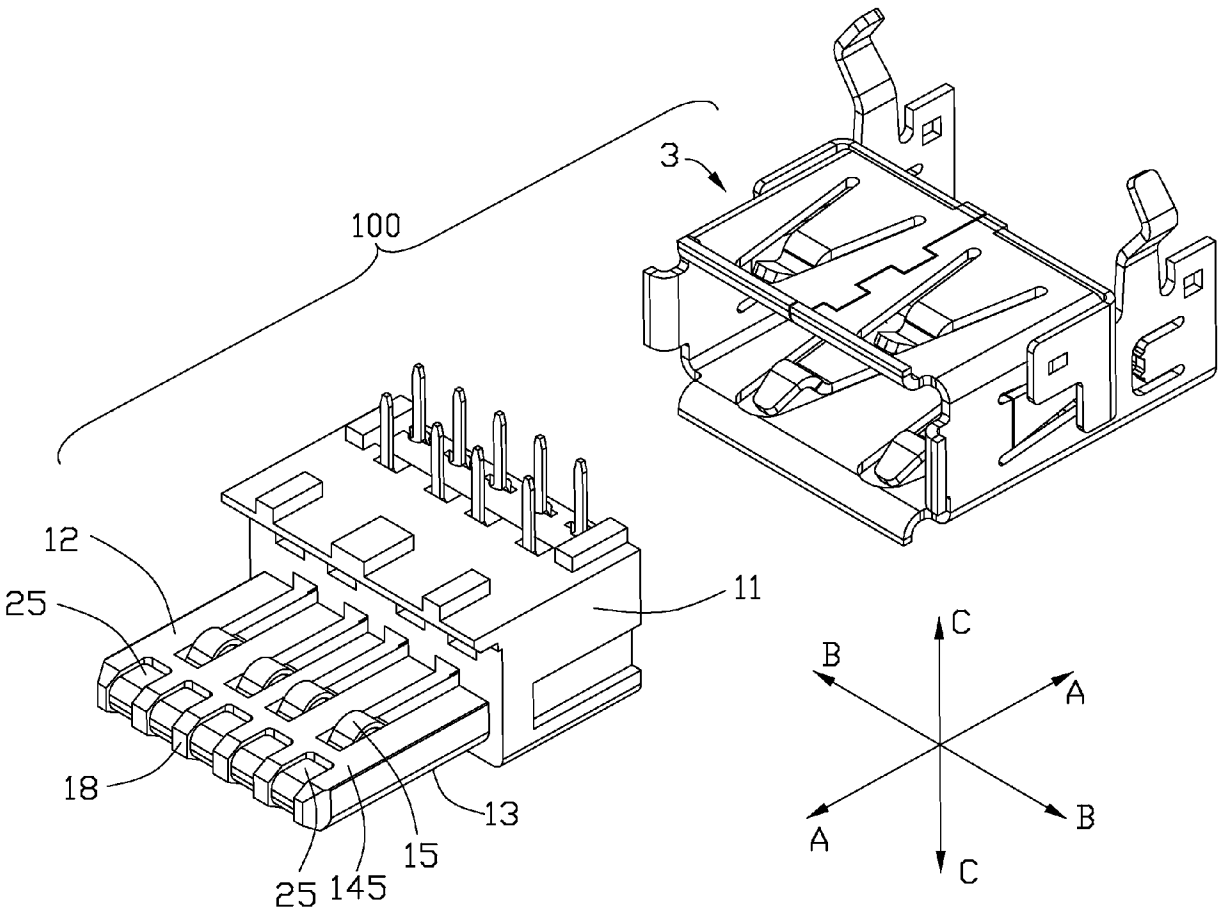
FIG. 7 is a partly assembly view of the electrical connector before assembly of a metal shell.

The insulative housing 1 includes a base portion 11 and a tongue portion 12 extending forwardly from a front surface 110 of the base portion 11. The base portion 11 includes a top section 111, a bottom section 112 opposite to the top section 111, and a pair of side walls 113. The top section 111 includes a protrusion 1111 on its middle area thereof. Each side wall 113 defines a cutout 1131. The protrusion 1111 and the cutout 1131 are used for abutting against the metal shell 3 which will be detailed hereinafter. The tongue portion 12 extends along a front-to-back direction A-A as shown in FIG. 7 and includes a top face 13, a mating face 14 opposite to the top face 13, and a front edge 18 opposite to the base portion 11. The top face 13 defines a plurality of slots 131 extending along the front-to-back direction A-A as best shown in FIGS. 5 and 6. The slots 131 further extend backwardly through the base portion 11. The mating face 14 includes a mounting surface 145 with a plurality of depressions 141 and a plurality of passageways 142 all recessed from the mounting surface 145. The passageways 142 are located at the rear of the depressions 141 in condition that the depressions 141 are located nearer to the front edge 18 than that of the passageways 142. The depressions 141 and the passageways 142 are arranged in two rows along the front-to-back direction A-A. Each row extends along a transverse direction B-B perpendicular to the front-to-back direction A-A. However, the depressions 141 are separated to the passageways 142. The tongue portion 12 has a plurality of ribs 146 in condition that each of the depressions is formed between the adjacent two ribs 146. The depressions 141 extend forwardly through the front edge 18 of the tongue portion 12, and the ribs 146 extend forwardly to the front edge 18 of the tongue portion 12. The tongue portion 12 has a plurality of recesses 127 recessed backwardly from the front edge 18 of the tongue portion 12 and communicating with the slots 131 and the depressions 141.

As shown in FIGS. 4-7, the contacts 2 include a plurality of conductive contacts 21 (first contacts) received in the passageways 142, and a plurality of additional contacts 22 (second contacts) received in the slots 131, recesses 127 and the depressions 141. Each conductive contact 21 includes an elastic first contact portion 15, a first connecting portion 17 horizontally extending backwardly from the first contact portion 15, and a first tail portion 16 extending downwardly from the first connecting portion 17. The first tail portion 16 is perpendicular to the first connecting portion 17. All the first contact portions 15 of the conductive contacts 21 are disposed side by side along the transverse direction B-B. The conductive contacts 21 are cantileveredly accommodated in the corresponding passageways 142 with the first contact portions 15 protruding downwardly beyond the mounting surface 145 so that the first contact portions 15 are deformable along a height direction C-C of the electrical connector 100 with insertion of the corresponding plug (not shown). The front-to-back direction A-A, the transverse direction B-B and the height direction C-C are perpendicular to each other.

Figure 3:
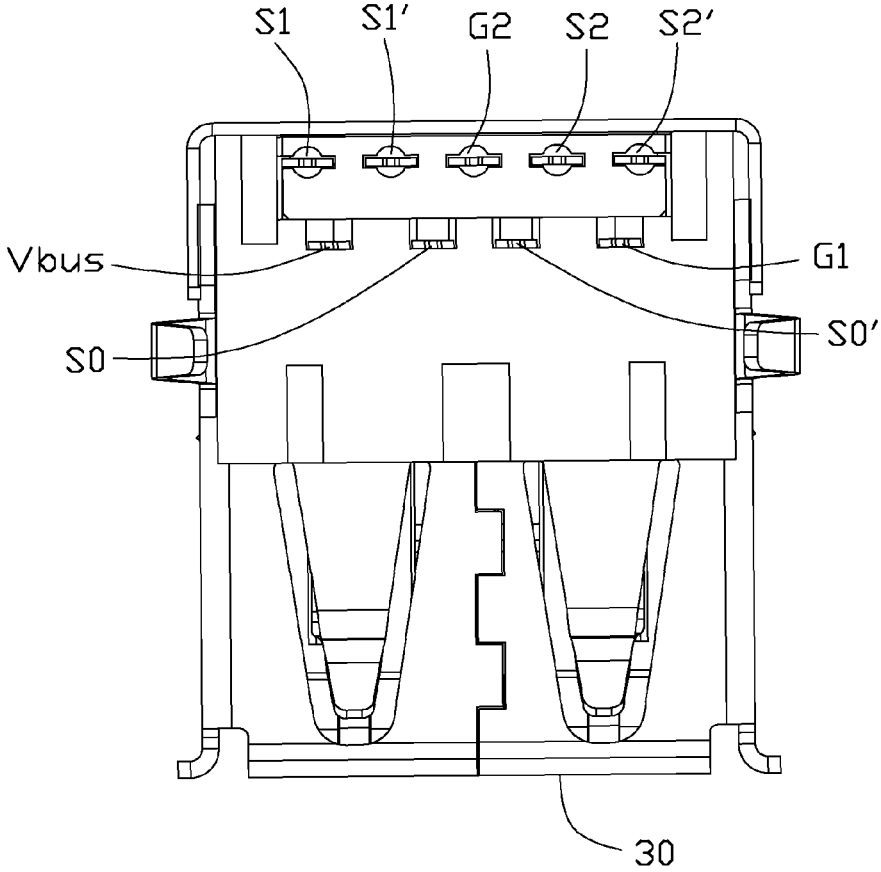
FIG. 3 is a bottom view of the electrical connector according to the first embodiment of the present invention.
Figure 4:
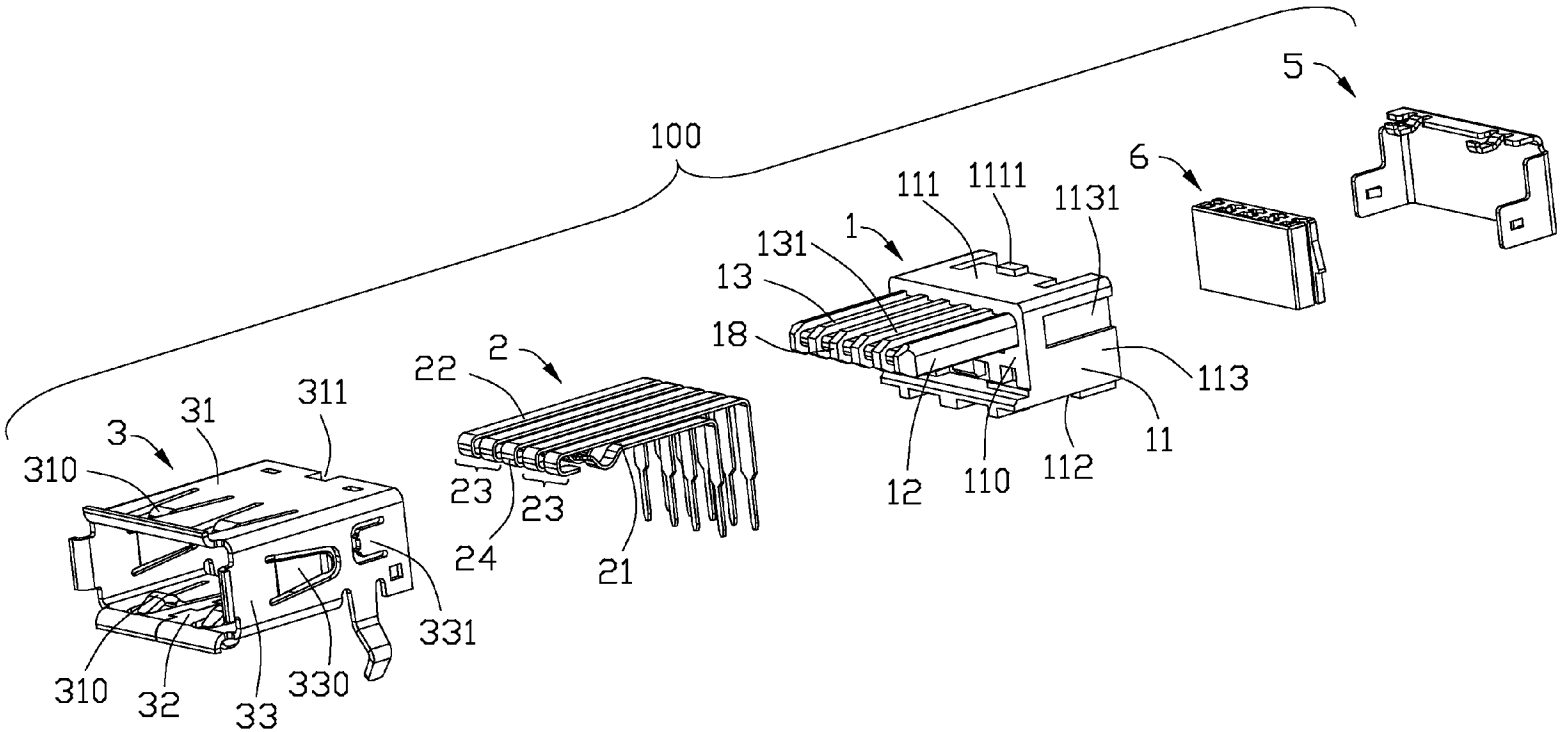
FIG. 4 is a partly exploded view of the electrical connector shown in FIG. 1.

As shown in FIGS. 3-5, the additional contacts 22 include two pairs of differential contacts 23 and a grounding contact 24. The two pairs of differential contacts 23 are used for transferring/receiving high-speed signals, and the grounding contact 24 is disposed between the two pairs of differential contacts 23 for reducing cross-talk. The additional contacts 22 are disposed side by side along the transverse direction B-B. Each additional contact 22 comprises a stiff and non-elastic second contact portion 25, a bending portion 26 bending upwardly from the second contact portion 25, a second connecting portion 27 extending backwardly from the bending portion 26 and along the tongue portion 12, and a second tail portion 28 bending downwardly from the second connecting portion 27. The second contact portion 25 and the second connecting portion 27 are parallel to the front-to-rear direction A-A while they are located on different horizontal levels. In detail, the second connecting portion 27 is located higher than the second contact portion 25. The bending portion 26 and the tail portion 28 are parallel to the height direction C-C.

In assembly, the contacts 2 are inserted into the insulative housing 1. The second connecting portions 27 are retained in the slots 131. The second contact portions 25 are received in the depressions 141. The second bending portions 27 are received in the recesses 127. The first contact portions 15 are received in the passageways 142. All the first and the second contact portions 15, 25 are positioned at a same side of the tongue portion 12. The first and the second contact portions 15, 25 are located on upper and lower sides of the mounting surface 145, wherein the first contact portions 15 are received in the passageways 142 and extend beyond the mounting surface 145, and the second contact portions 25 are received in the depressions 141 and located at an inner side of the mounting surface 145. The first and the second contact portions 15, 25 are arranged in two parallel rows along the front-to-rear direction A-A in condition that the second contact portions 25 are nearer to the front edge 18 than that of the first contact portions 15 as best shown in FIG. 7. The first and the second contact portions 15, 25 are separate along the front-to-rear direction A-A to prevent disordered signal transmission. When the corresponding plug is inserted into the electrical connector 100 for mating with the conductive contacts 21 and the additional contacts 22, the ribs are for filling in a gap between the tongue portion and tongue plate of the plug. The first connecting portions 17 are parallel to the second connecting portions 27 while they are located on different horizontal levels. The bending portions 26 are received in the corresponding recesses 127 so that said bending portions 26 are protectively located behind the front edge 18 of the tongue portion 12. The second tail portions 28 are designated with symbols S1, S1', S2, S2' and G2 respectively corresponding to the two pairs of differential contacts 23 and the grounding contact 24, wherein the second tail portions S1 and S1' are corresponding to one pair of differential contacts 23, the second tail portions S2 and S2' are corresponding to the other pair of differential contacts 23, and the second tail portion G2 are corresponding to the grounding contact 24.

Figure 49:
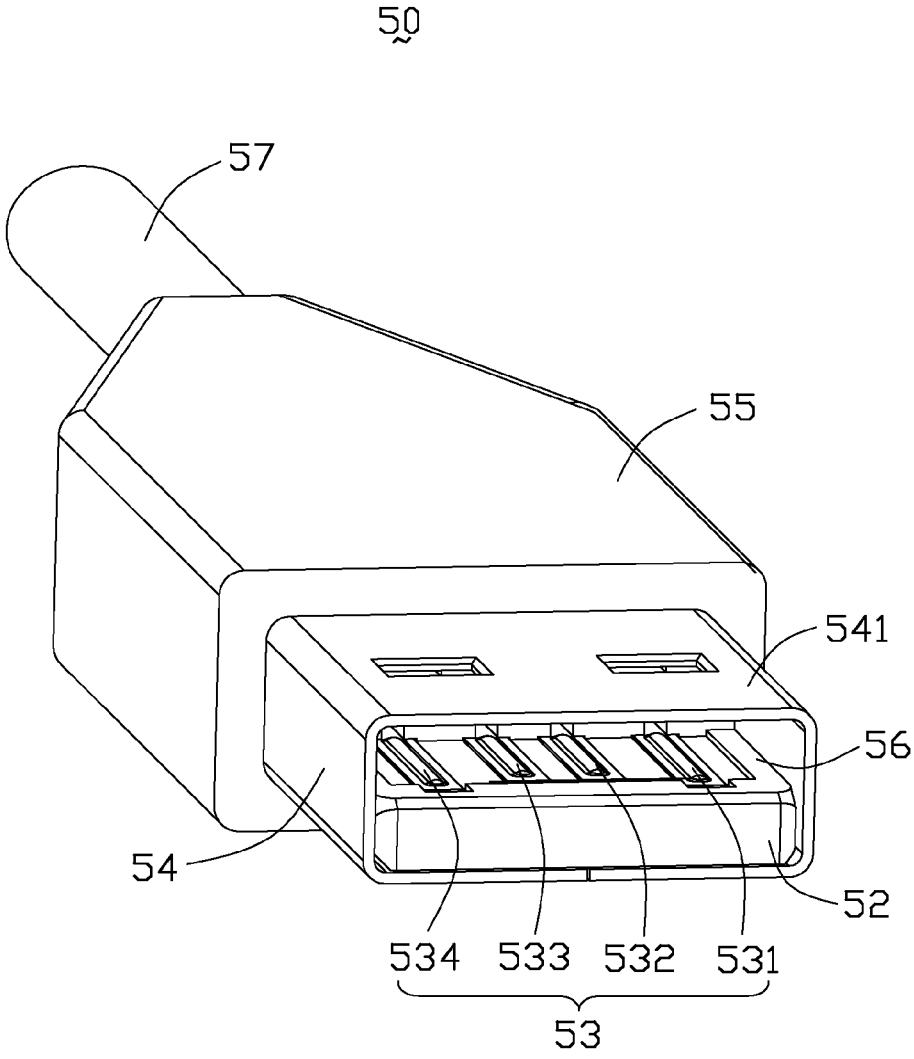
FIG. 49 is a perspective schematic view of the standard type-A USB 2.0 plug connecting with a cable.
Figure 50:
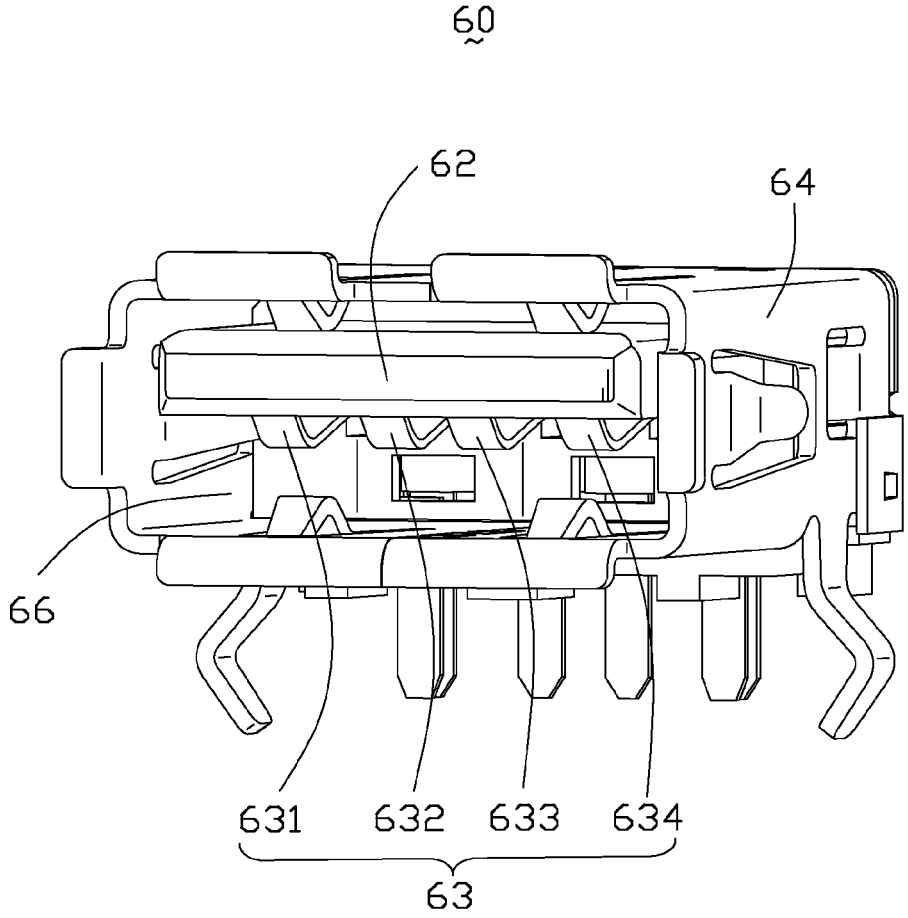
FIG. 50 is a perspective view of an existing standard type-A USB 2.0 receptacle.

The electrical connector 100 is compatible to the standard type-A USB 2.0 plug 50 shown in FIG. 49. In order not to enlarge the profile of the electrical connector 100, a geometric profile of the tongue portion 12 is substantially the same as the tongue portion 62 of the standard type-A USB 2.0 receptacle 60 within an allowable tolerance, that is to say, length, width and height of the tongue portion 12 are substantially equal to the tongue portion 62. The number of the conductive contacts 21 is four and the arrangement of the conductive contacts 21 is compatible to USB 2.0 protocol to transmit USB signals. The four conductive contacts 21 are designated with numeral 211, 212, 213 and 214 for easy description hereinafter. The four conductive contacts 211, 212, 213 and 214 are adapted for power (VBUS) signal, −data signal, +data signal and grounding, respectively. So now, from assignment of the conductive contacts standpoint, different terminologies are given to each of the four conductive contacts 211, 212, 213 and 214. The four conductive contacts 211, 212, 213 and 214 are respectively named as power contact 211, −data contact 212, +data contact 213 and ground contact 214. The first tail portions 16 are designated with symbols Vbus, S0, S0' and G1 respectively corresponding to the power contact 211, −data contact 212, +data contact 213 and ground contact 214.

Regarding FIGS. 4-7, the metal shell 3 is in a tube shape, which defines a top face 31, a bottom face 32 opposite to the top face 31 and a pair of sidewalls 33 connecting the top face 31 and the bottom face 32. The metal shell 3 is secured to the base portion 11 to enclose the tongue portion 12 to form a receiving space 10 into which the tongue portion 12 extends. The top face 31 defines a slit 311 for receiving the protrusion 1111 of the insulative housing 1. Each sidewall 33 includes a projection 331 for abutting against the cutout 1131 of the insulative housing 1. Thus, the metal shell 3 can be secured to the base portion 11 firmly. The top face 31, the bottom face 32 and the sidewalls 33 all include at least one spring 310, 330 protruding into the receiving space 10 for retaining the corresponding inserted plug. The first contact portions 15 protrude into the receiving space 10 and the second contact portions 25 are exposed to the receiving space 10.

As shown in FIG. 3, the electrical connector further defines a front face 30 opposite to the base portion 11 of the insulative housing 1. The first and the second tail portions Vbus, S0, S0', G1 and S1, S1', G2, S2, S2' are arranged in first and second rows along the front-to-rear direction A-A. Each first or second rows are parallel to the transverse direction B-B.

Figure 16:
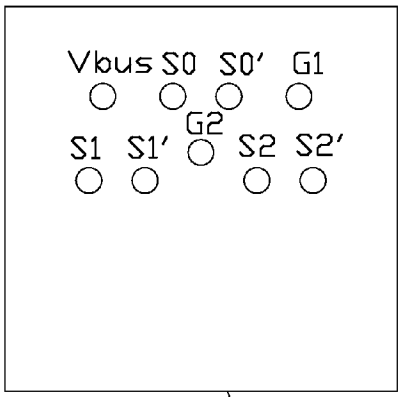
FIG. 16 is a schematic bottom view of an electrical connector according to a fifth embodiment of the present invention.
Figure 15:
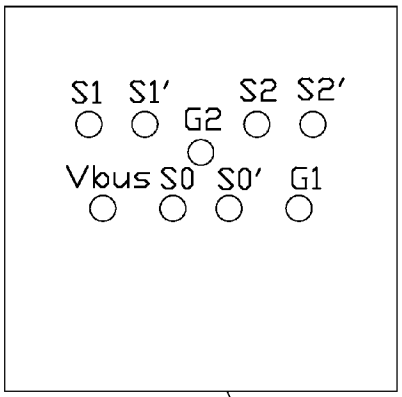
FIG. 15 is a schematic bottom view of an electrical connector according to a fourth embodiment of the present invention.

Referring to FIGS. 14 to 22, a third to an eleventh embodiment are disclosed. Such embodiments are similar to the first embodiment and the differences between them are the contact arrangements. The first and the second tail portions Vbus, S0, S0', G1 and S1, S1', G2, S2, S2' are arranged in other two rows or in three rows. Referring to FIGS. 15 and 16, the second tail portions S1, S1', S2, S2' are arranged in a first row, the first tail portions Vbus, S0, S0', G1 are arranged in a second row, and the second tail portion G2 is arranged in a middle row between the first and the second rows. The first and the second rows as well as the middle row are parallel to the transverse direction B-B.

Figure 18:
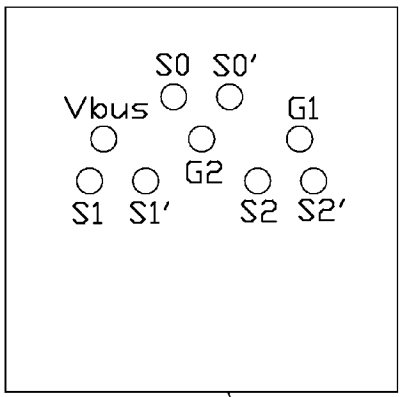
FIG. 18 is a schematic bottom view of an electrical connector according to a seventh embodiment of the present invention.
Figure 14:
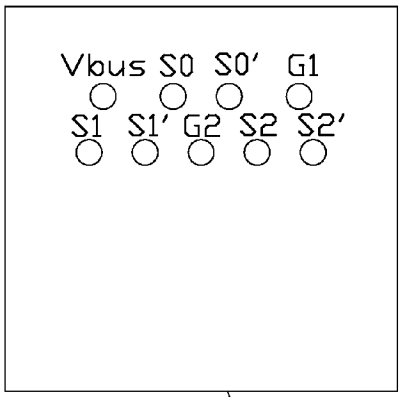
FIG. 14 is a schematic bottom view of an electrical connector according to a third embodiment of the present invention.
Figure 17:
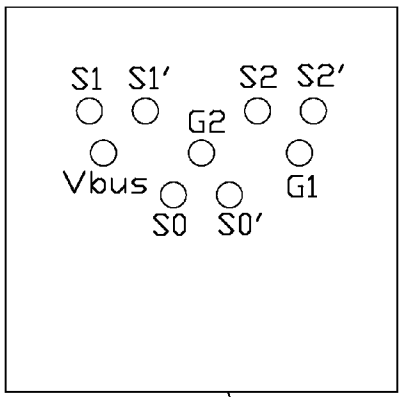
FIG. 17 is a schematic bottom view of an electrical connector according to a sixth embodiment of the present invention.
Figure 19:
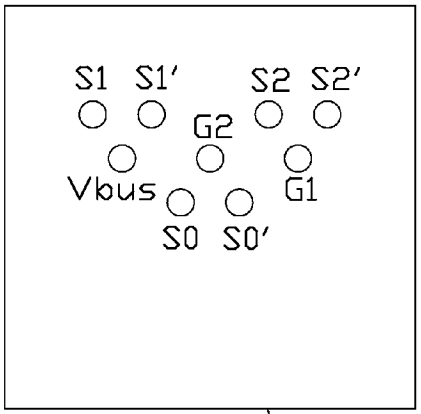
FIG. 19 is a schematic bottom view of an electrical connector according to an eighth embodiment of the present invention.
Figure 20:
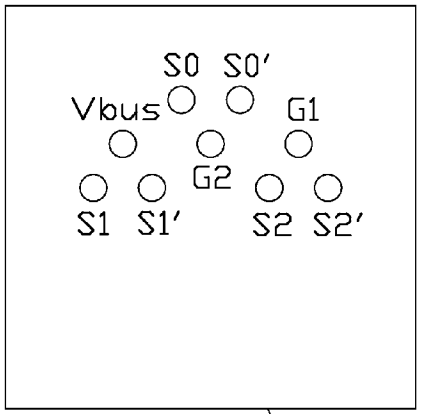
FIG. 20 is a schematic bottom view of an electrical connector according to a ninth embodiment of the present invention.

Referring to FIGS. 17 and 18, the second tail portions S1, S1', S2, S2' are arranged in a first row, the first tail portions S0, S0' are arranged in a second row, and the rest first and the second tail portions Vbus, G1 and G2 are arranged in a middle row between the first and the second rows. The first and the second rows as well as the middle row are parallel to the transverse direction B-B. The second tail portions S1, S1' are associated with the first tail portion Vbus in a first triangular pattern. The first tail portions S0, S0' are associated with the second tail portion G2 in a second triangular pattern. The second tail portions S2, S2' are associated with the first tail portion G1 in a third triangular pattern. Referring to FIGS. 19 and 20, the first, the second and the third triangular pattern are all equilateral triangles in order to reduce cross-talk between the contacts 2 in their signal transmission.

Figure 21:
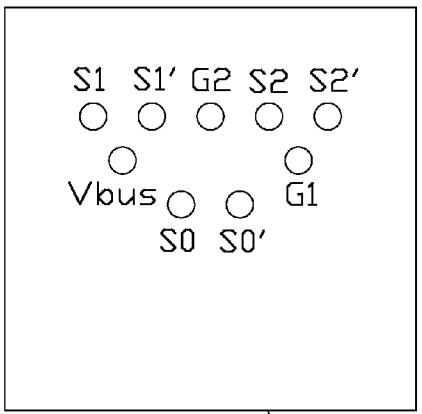
FIG. 21 is a schematic bottom view of an electrical connector according to a tenth embodiment of the present invention.
Figure 22:
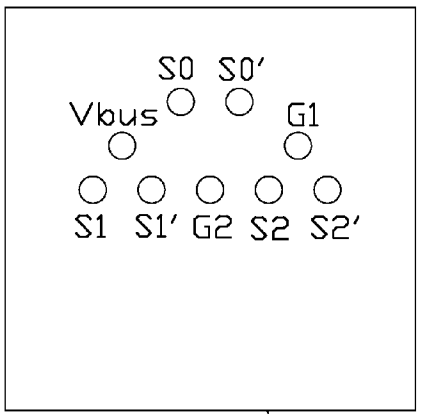
FIG. 22 is a schematic bottom view of an electrical connector according to an eleventh embodiment of the present invention.
Figure 23:
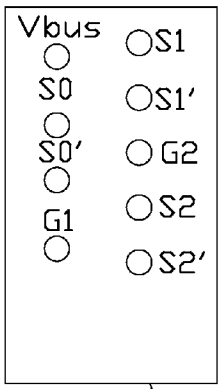
FIG. 23 is a schematic bottom view of an electrical connector according to a twelfth embodiment of the present invention.
Figure 24:
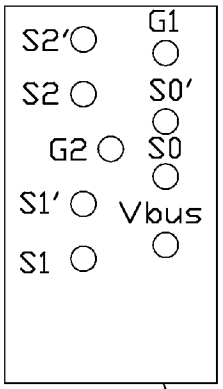
FIG. 24 is a schematic bottom view of an electrical connector according to a thirteenth embodiment of the present invention.
Figure 25:
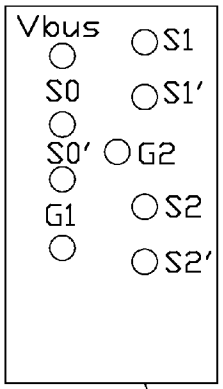
FIG. 25 is a schematic bottom view of an electrical connector according to a fourteenth embodiment of the present invention.
Figure 26:
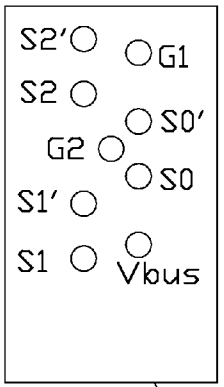
FIG. 26 is a schematic bottom view of an electrical connector according to a fifteenth embodiment of the present invention.
Figure 27:
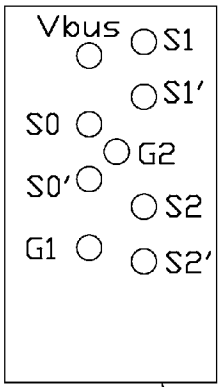
FIG. 27 is a schematic bottom view of an electrical connector according to a sixteenth embodiment of the present invention.
Figure 29:
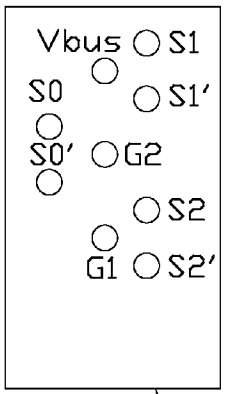
FIG. 29 is a schematic bottom view of an electrical connector according to an eighteenth embodiment of the present invention.
Figure 31:
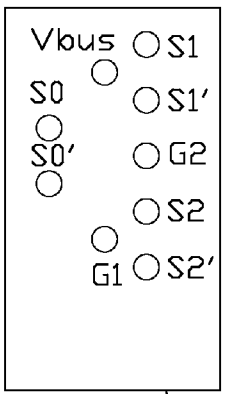
FIG. 31 is a schematic bottom view of an electrical connector according to a twentieth embodiment of the present invention.
Figure 28:
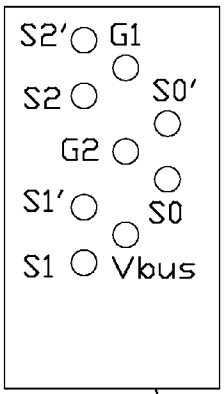
FIG. 28 is a schematic bottom view of an electrical connector according to a seventeenth embodiment of the present invention.
Figure 30:
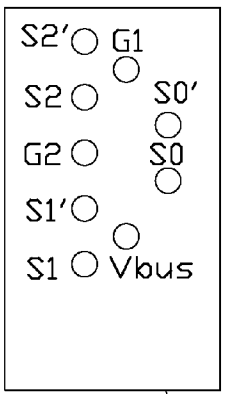
FIG. 30 is a schematic bottom view of an electrical connector according to a nineteenth embodiment of the present invention.
Figure 32:
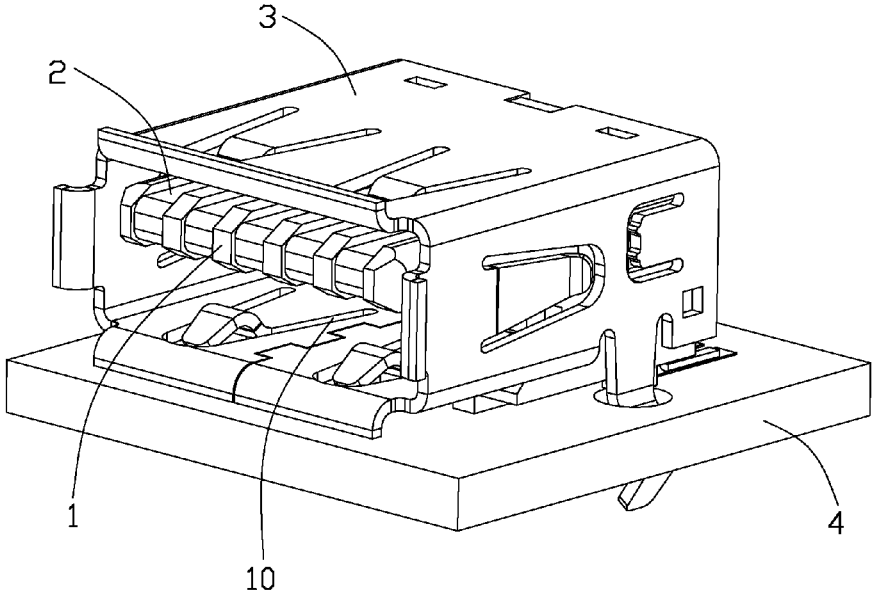
FIG. 32 is a perspective view of an electrical connector mounted on a PCB according to a twenty-first embodiment of the present invention.
Figure 33:
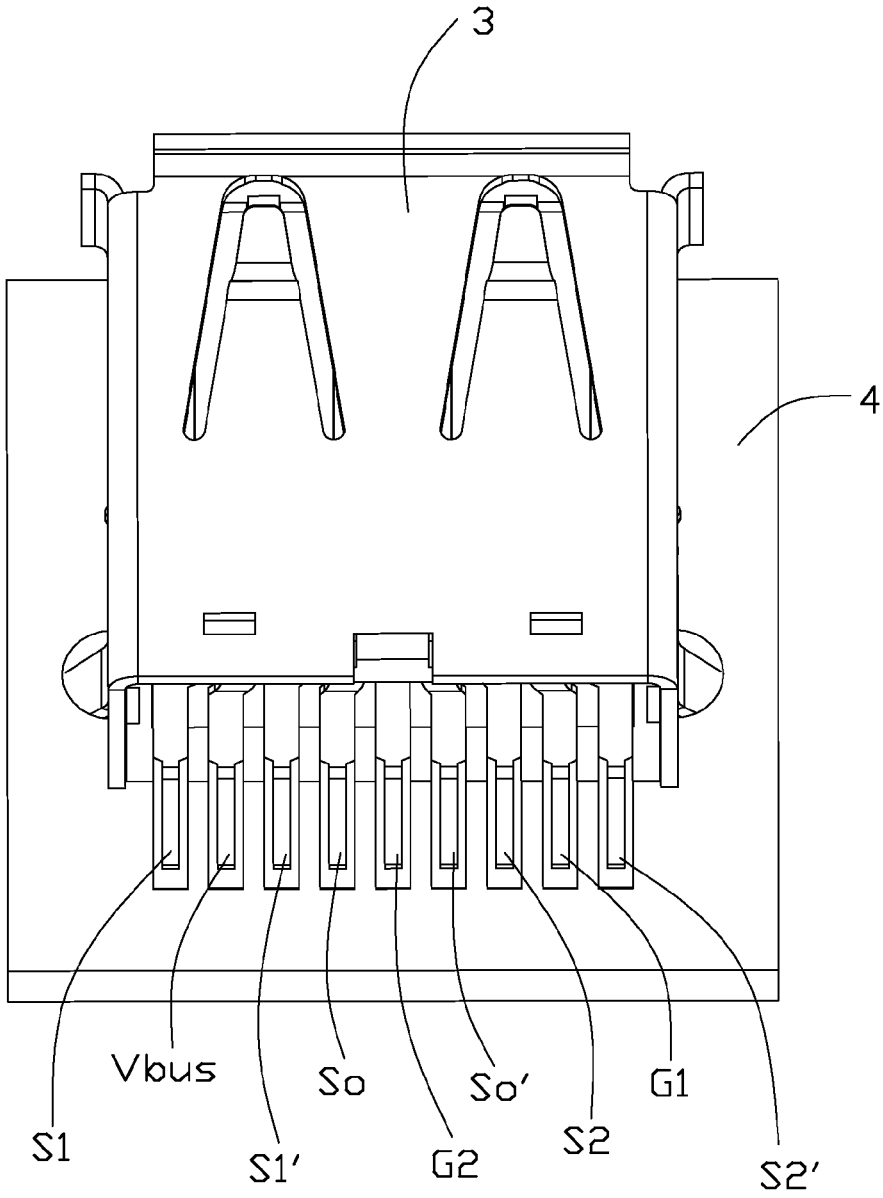
FIG. 33 is another perspective view of the electrical connector mounted on the PCB shown in FIG. 32, while taken from another aspect.
Figure 34:
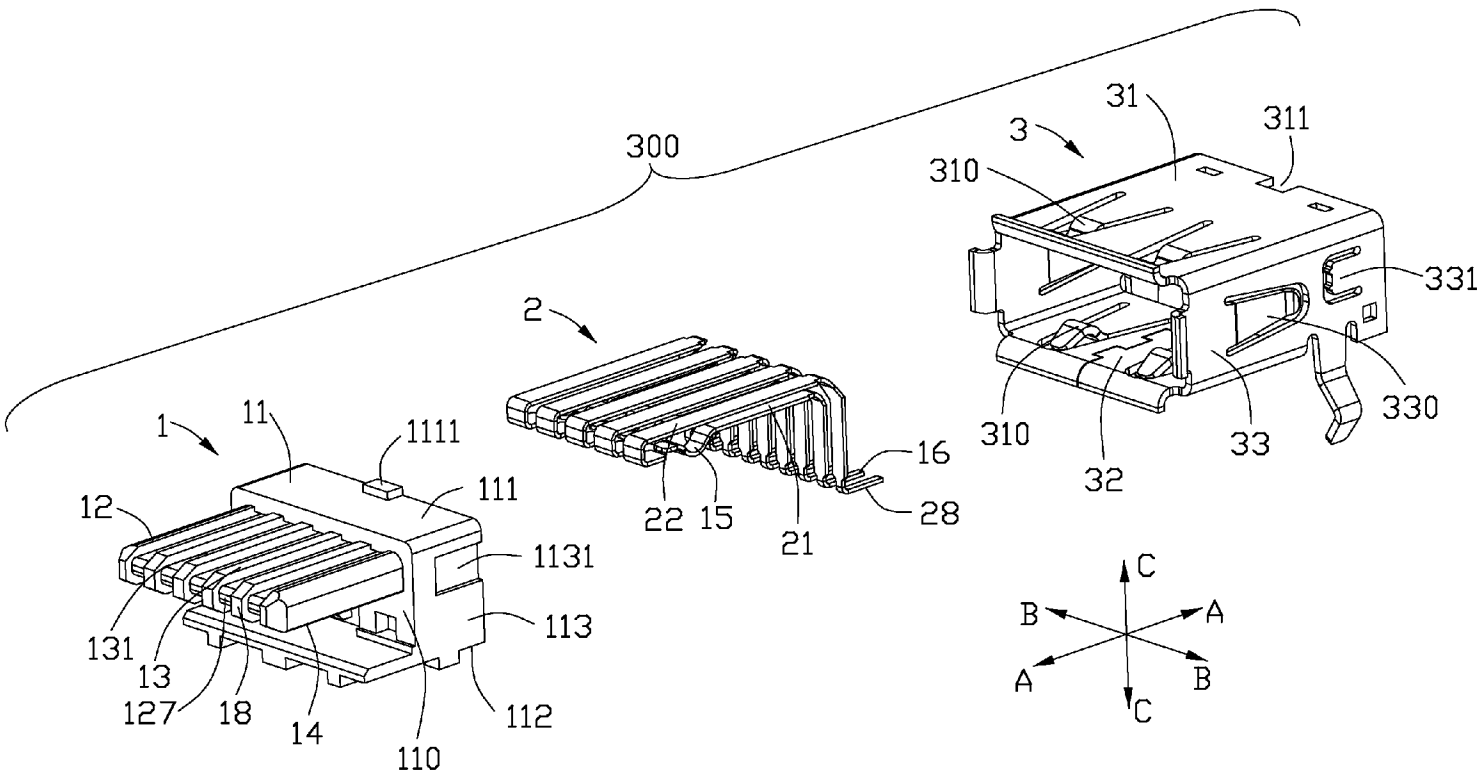
FIG. 34 is a partly exploded view of the electrical connector according to the twenty-first embodiment of the present invention.
Figure 35:
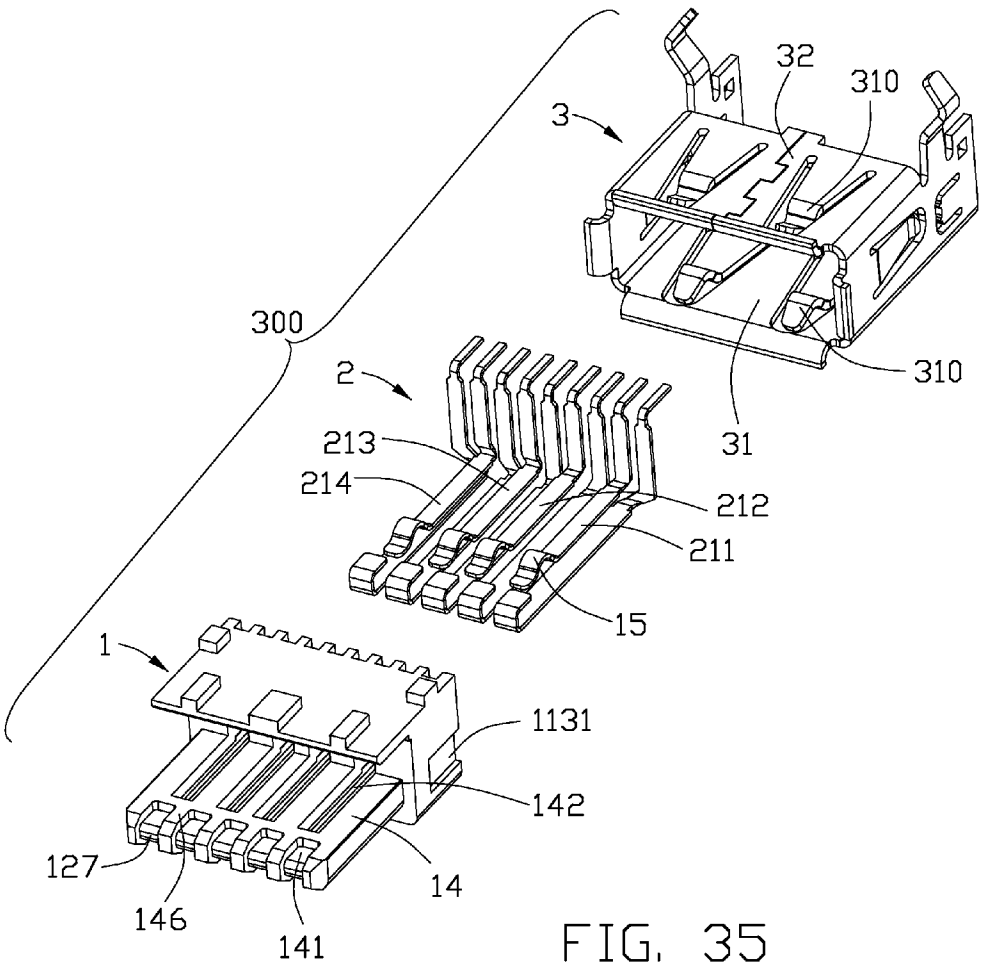
FIG. 35 is a partly exploded view of the electrical connector shown in FIG. 34, while taken from another aspect.
Figure 36:
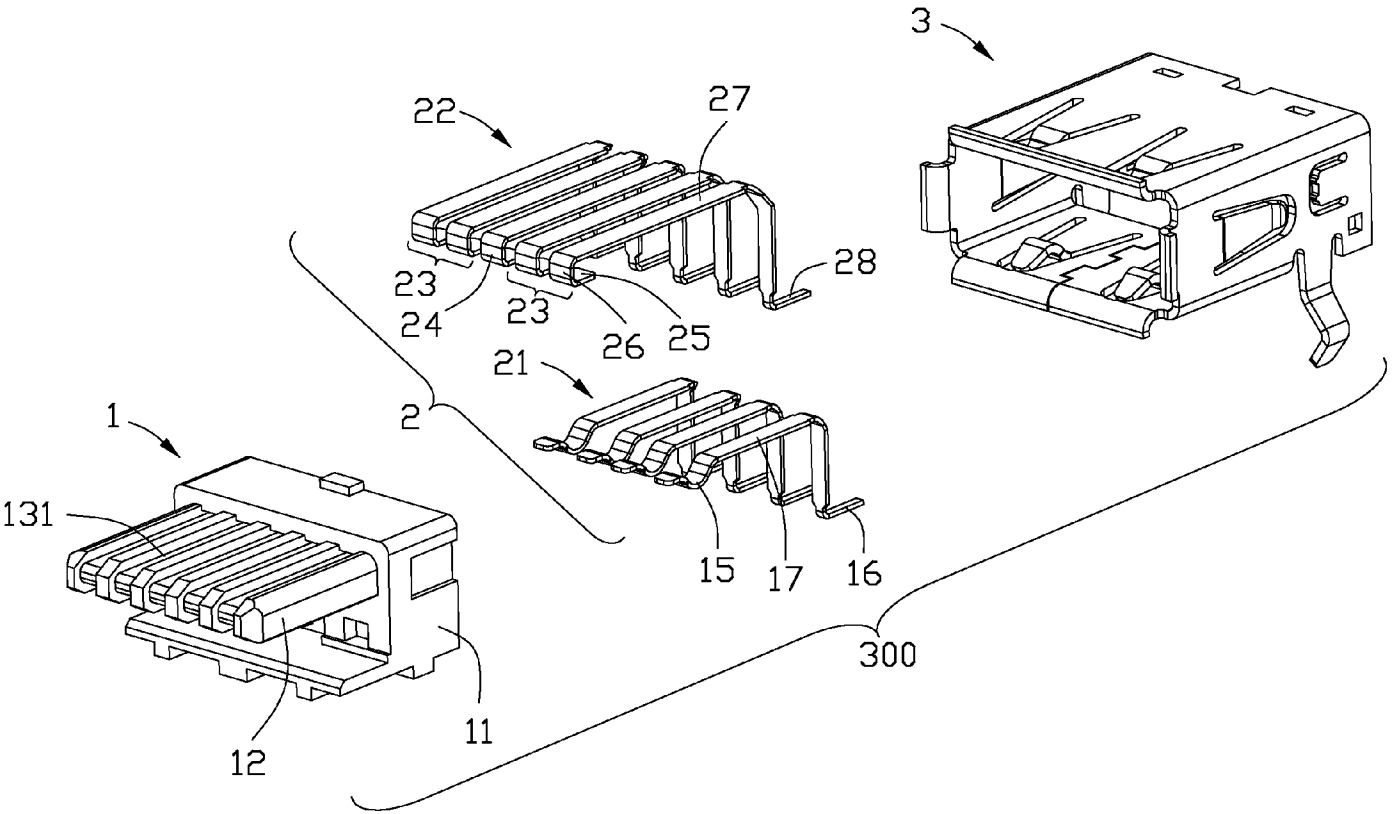
FIG. 36 is an exploded view of the electrical connector shown in FIG. 34 illustrating conductive contacts are separate from additional contacts.
Figure 37:
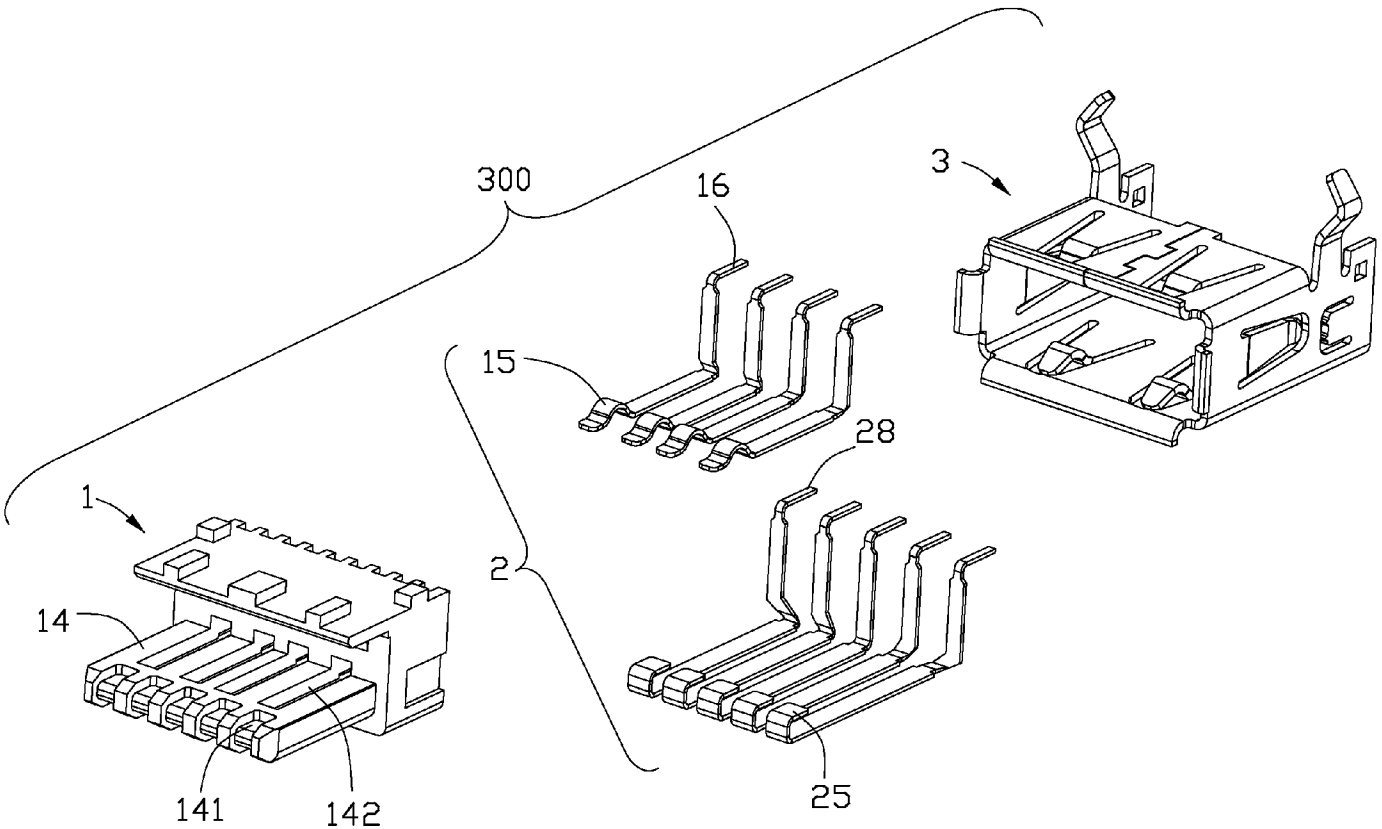
FIG. 37 is an exploded view of the electrical connector shown in FIG. 36, but viewed from another aspect.
Figure 38:
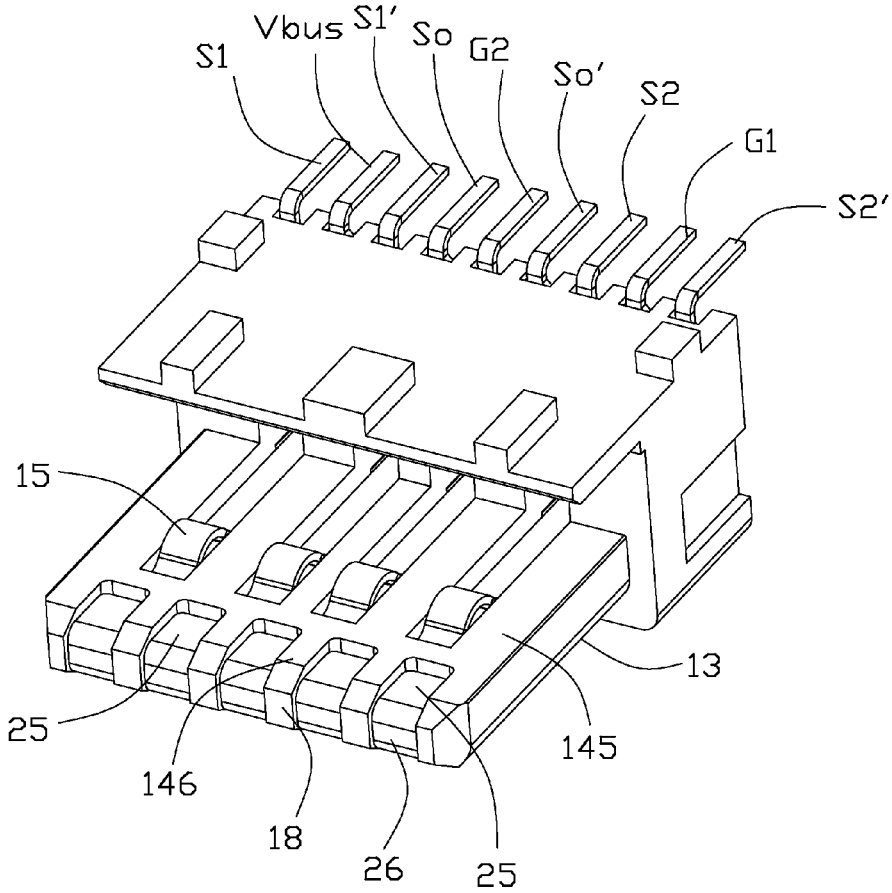
FIG. 38 is a partly assembly view of the electrical connector with insertion of the conductive contacts and the additional contacts into an insulative housing.
Figure 39:
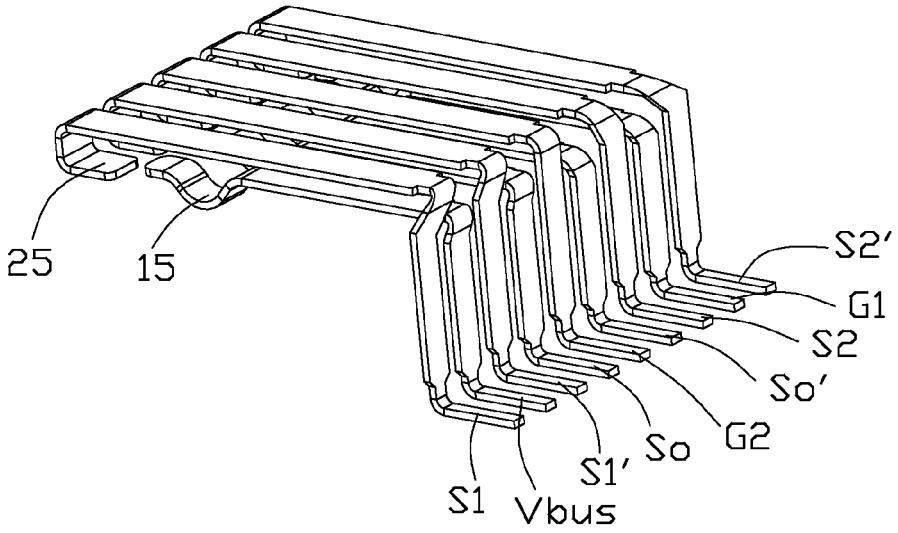
FIG. 39 is a perspective view of the conductive contacts and the additional contacts shown in FIG. 34, but viewed from different aspect.

Referring to FIGS. 21 and 22, the second tail portions S1, S1', S2, S2' and G2 are arranged in a first row, the first tail portions S0, S0' are arranged in a second row, and the rest first tail portions Vbus, G1 are arranged in a middle between the first and the second rows. In the above embodiments, the first tail portion G1 and the second tail portion G2 are located adjacent the first and the second tail portions S1 and S1', S2 and S2, and S0 and S0' in order to reduce cross-talk between the contacts 2 in their signal transmission.

Figure 8:
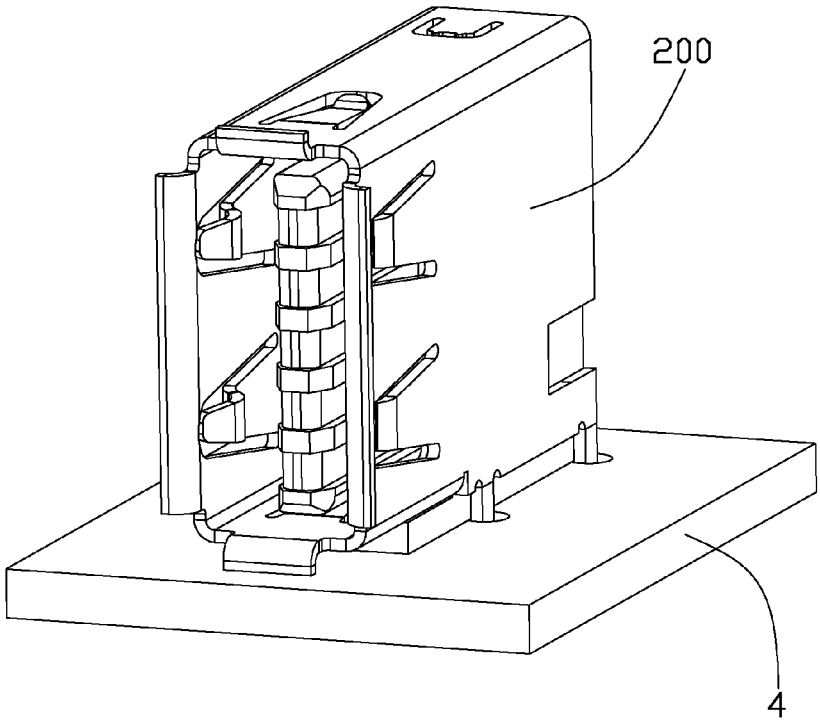
FIG. 8 is a perspective view of an electrical connector mounted on the PCB according to a second embodiment of the present invention.
Figure 9:
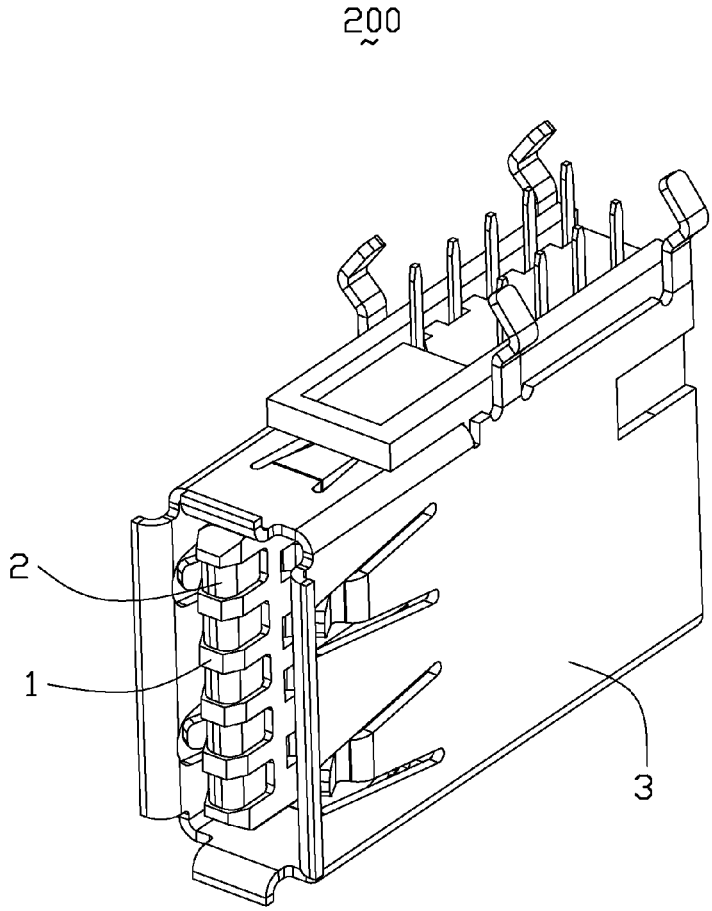
FIG. 9 is another perspective view of the electrical connector shown in FIG. 8, but viewed from another aspect.
Figure 10:
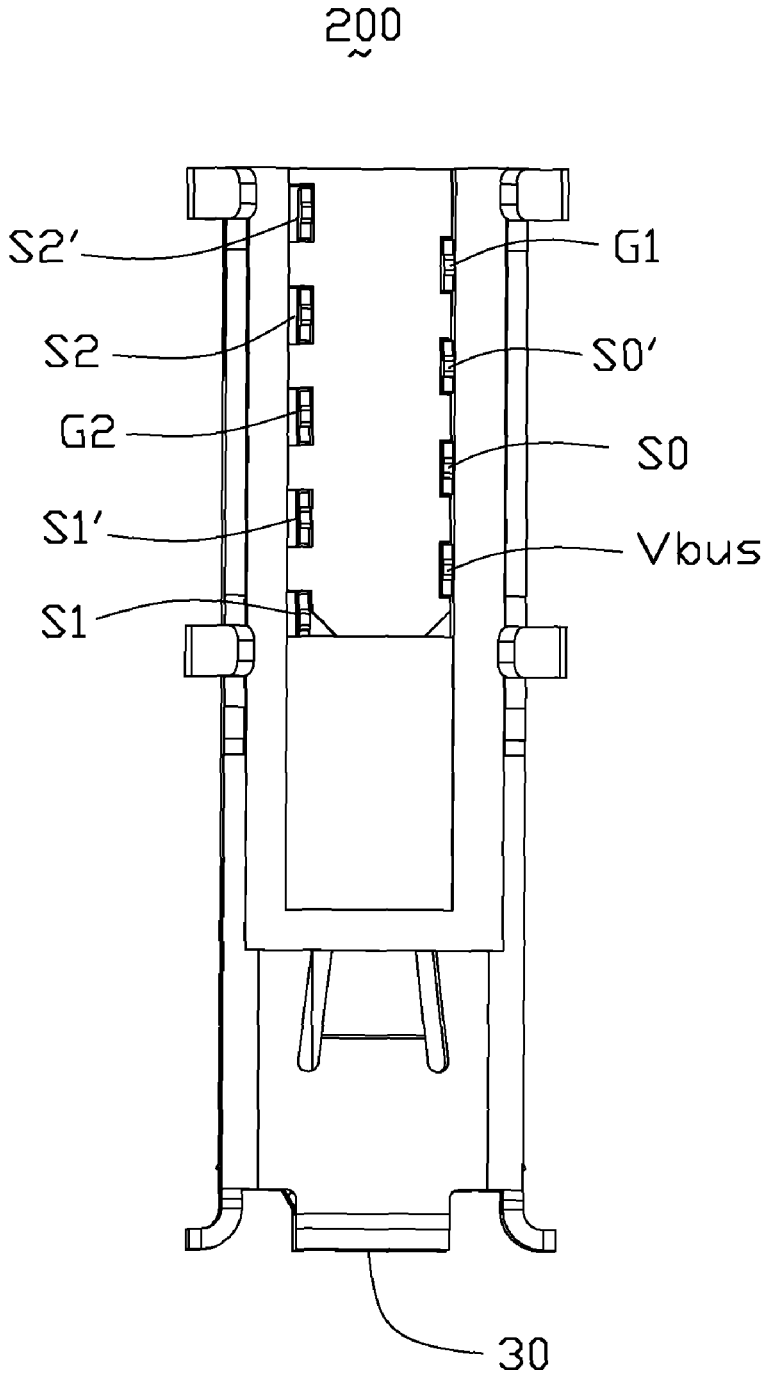
FIG. 10 is a bottom view of the electrical connector shown in FIG. 9.
Figure 11:
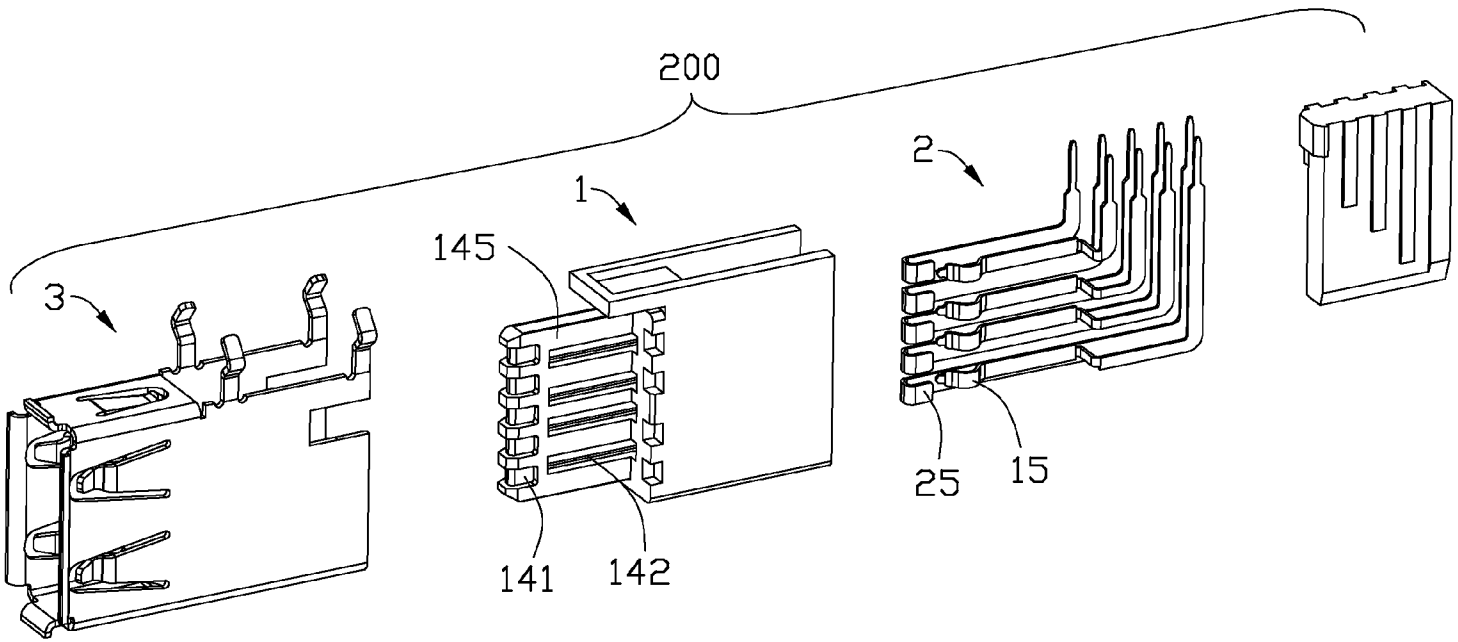
FIG. 11 is a partly exploded view of the electrical connector according to the second embodiment of the present invention.
Figure 12:
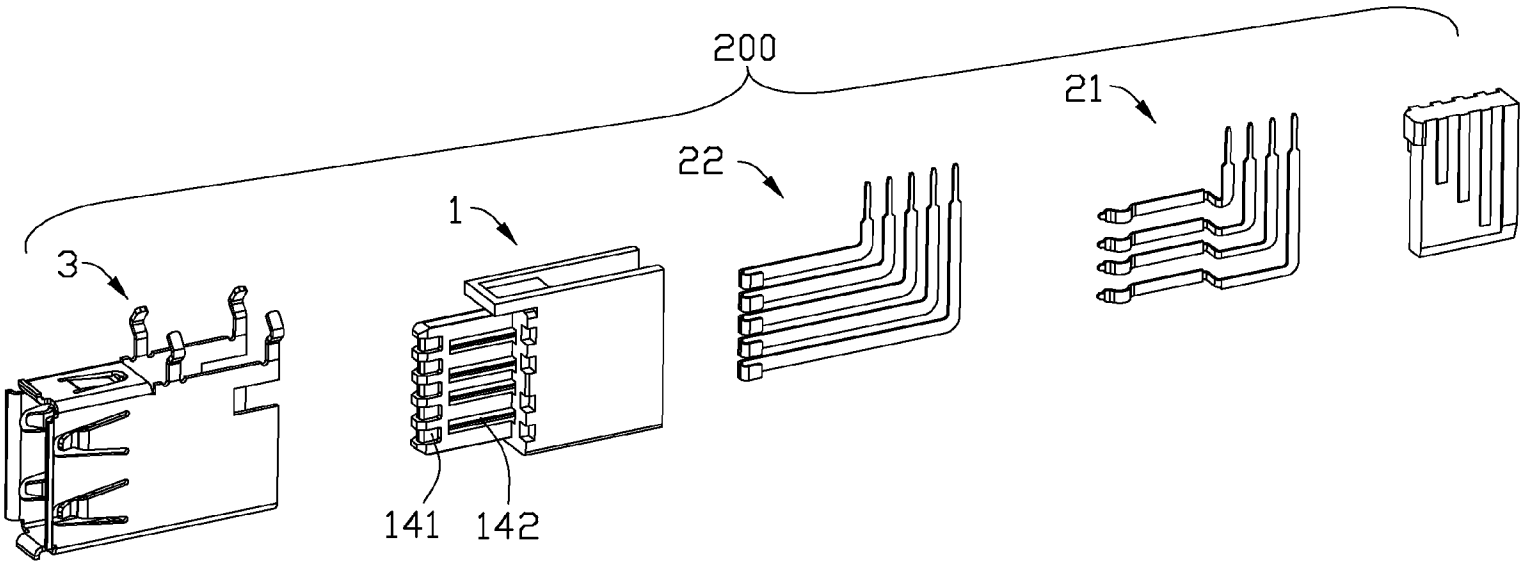
FIG. 12 is an exploded view of the electrical connector shown in FIG. 11 illustrating conductive contacts are separate from additional contacts.
Figure 13:
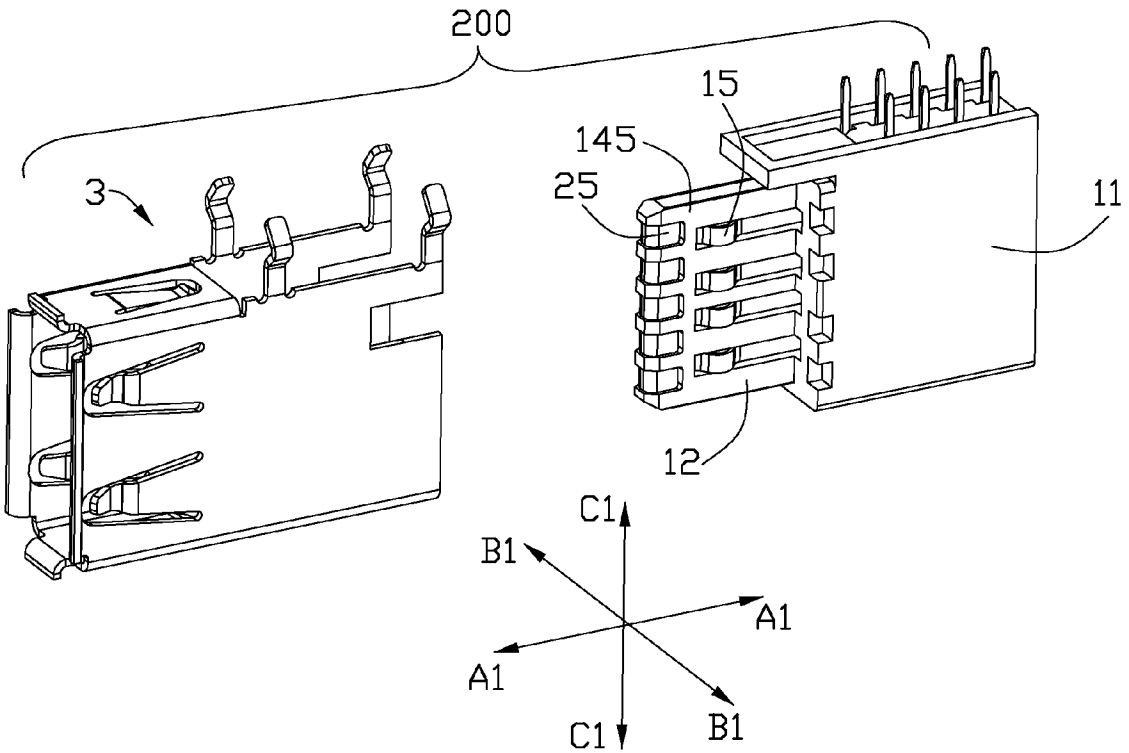
FIG. 13 is a partly assembly view of the electrical connector according to the second embodiment of the present invention before assembly of a metal shell.

Referring to FIGS. 8 to 13, a second embodiment of the present invention discloses an electrical connector 200 which is much similar to the electrical connector 100 of the first embodiment. The difference between them are that the tongue portion 12 of the electrical connector 100 is parallel to the PCB 4 while the tongue portion 12 of the electrical connector 200 is perpendicular to the PCB 4 as best shown in FIG. 8. The depressions 141 are disposed along a vertical direction C1-C1 as well as the passageways 142 as shown in FIGS. 11 and 12. The first and the second tail portions Vbus, S0, S0', G1 and S1, S1', G2, S2, S2' are arranged in first and second rows, respectively, along a front-to-rear direction A1-A1. Each first or second rows are parallel to the front-to-rear direction B1-B1. Referring to FIGS. 23 to 31, in other embodiments, the first and the second tail portions Vbus, S0, S0', G1 and S1, S1', G2, S2, S2' can be arranged in other two rows or three rows. The detailed description of such embodiments is omitted since they are similar to embodiments shown in FIGS. 14 to 22.

Figure 2:
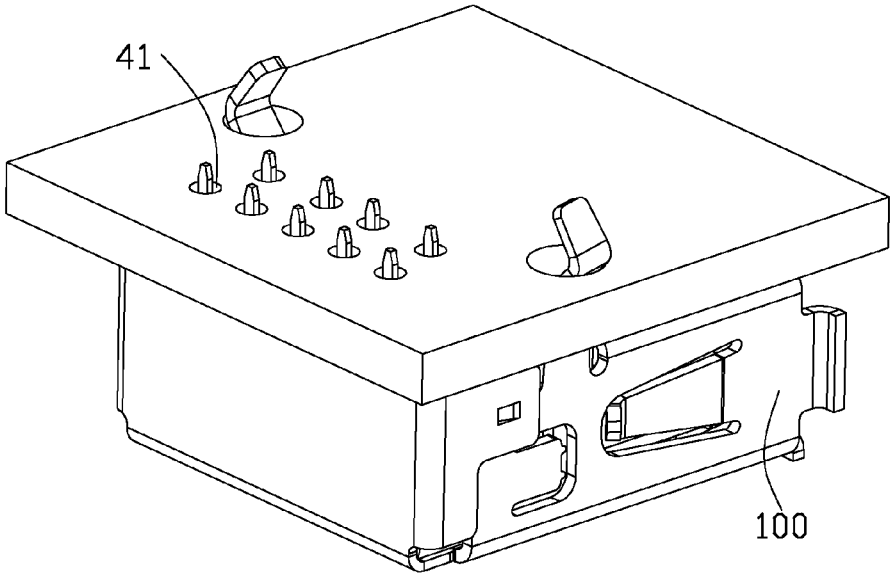
FIG. 2 is another perspective view of the electrical connector mounted on the PCB, but viewed from another aspect.

Referring to FIGS. 32 to 39, a twenty-first embodiment of the present invention discloses an electrical connector 300 which is similar to the electrical connector 100 of the first embodiment. The difference between them is that the first and the second tail portions Vbus, S0, S0', G1 and S1, S1', G2, S2, S2' are arranged in at least two rows of the electrical connector 100 while such first and the second tail portions Vbus, S0, S0', G1 and S1, S1', G2, S2, S2' of the electrical connector 300 are arranged in only a single row along the transverse direction B-B as shown in FIGS. 2 and 3. The first and the second tail portions are arranged in condition of S1, Vbus, S1', S0, G2, S0', S2, G1, S2' in turn.

Figure 40:
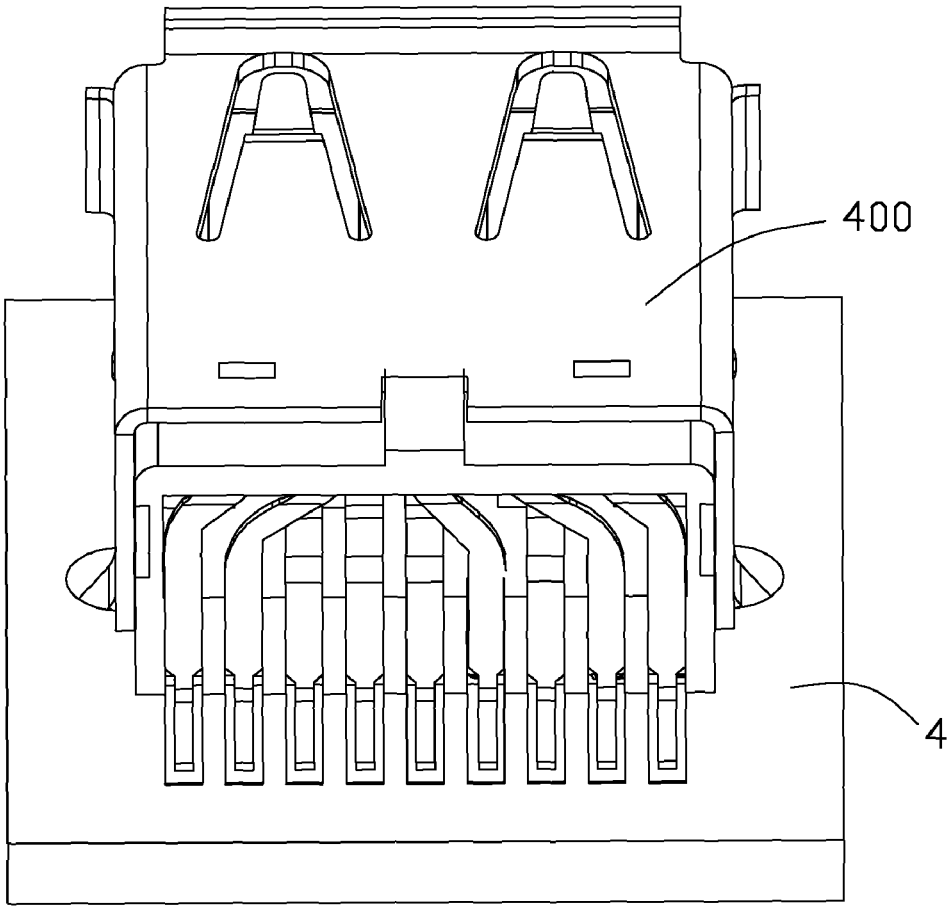
FIG. 40 is a perspective view of an electrical connector mounted on a PCB according to a twenty-second embodiment of the present invention.
Figure 41:
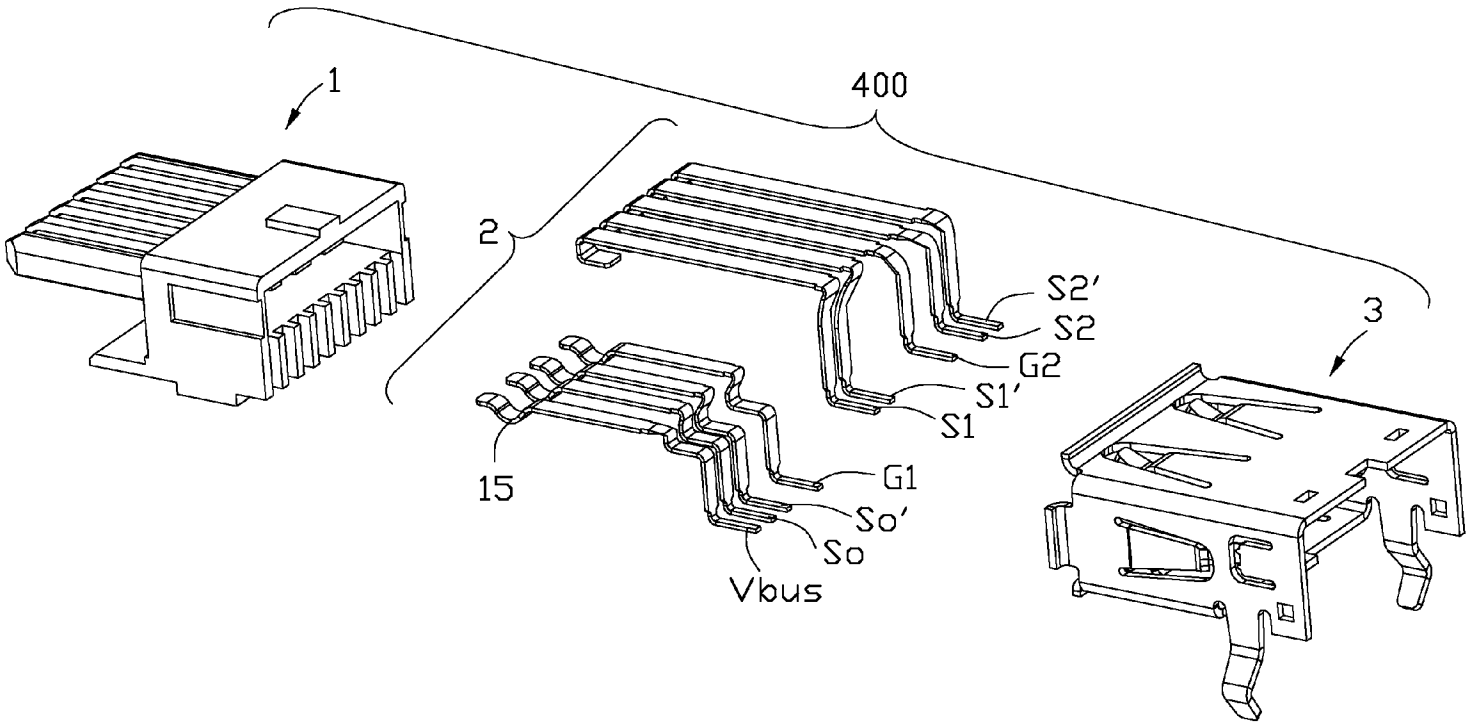
FIG. 41 is an exploded view of the electrical connector shown in FIG. 40 illustrating conductive contacts are separate from additional contacts.
Figure 42:
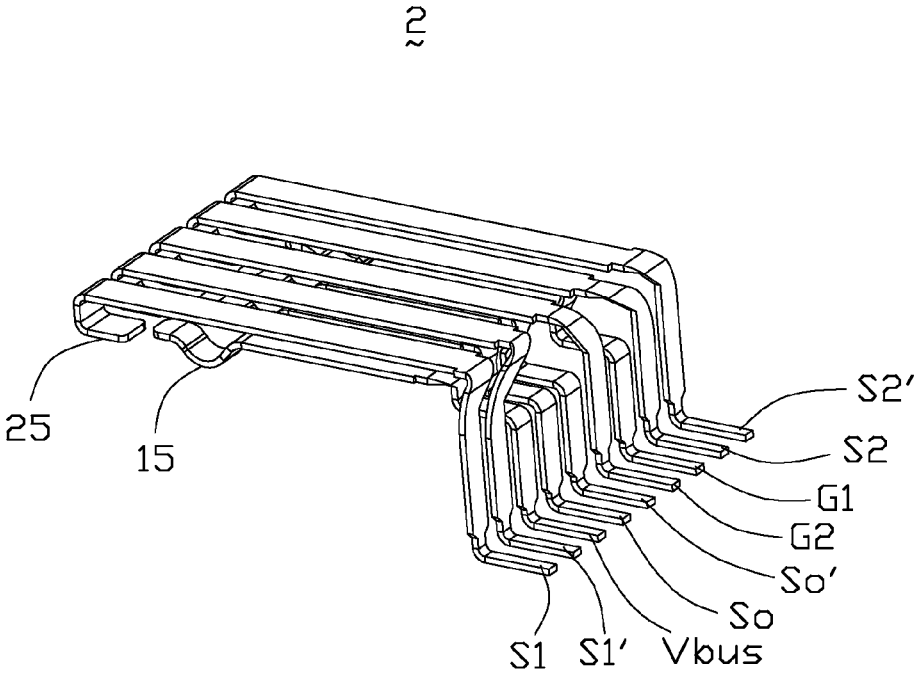
FIG. 42 is a perspective view of the conductive contacts and the additional contacts shown in FIG. 41, while taken from another aspect.

Referring to FIGS. 40 to 42, a twenty-second embodiment of the present invention discloses an electrical connector 400 which is similar to the electrical connector 300 of the twenty-first embodiment. The difference between them is that the first and the second tail portions Vbus, S0, S0', G1 and S1, S1', G2, S2, S2' are arranged in condition of S1, S1', Vbus, S0, S0', G2, G1, S2, S2' in turn.

Figure 43:
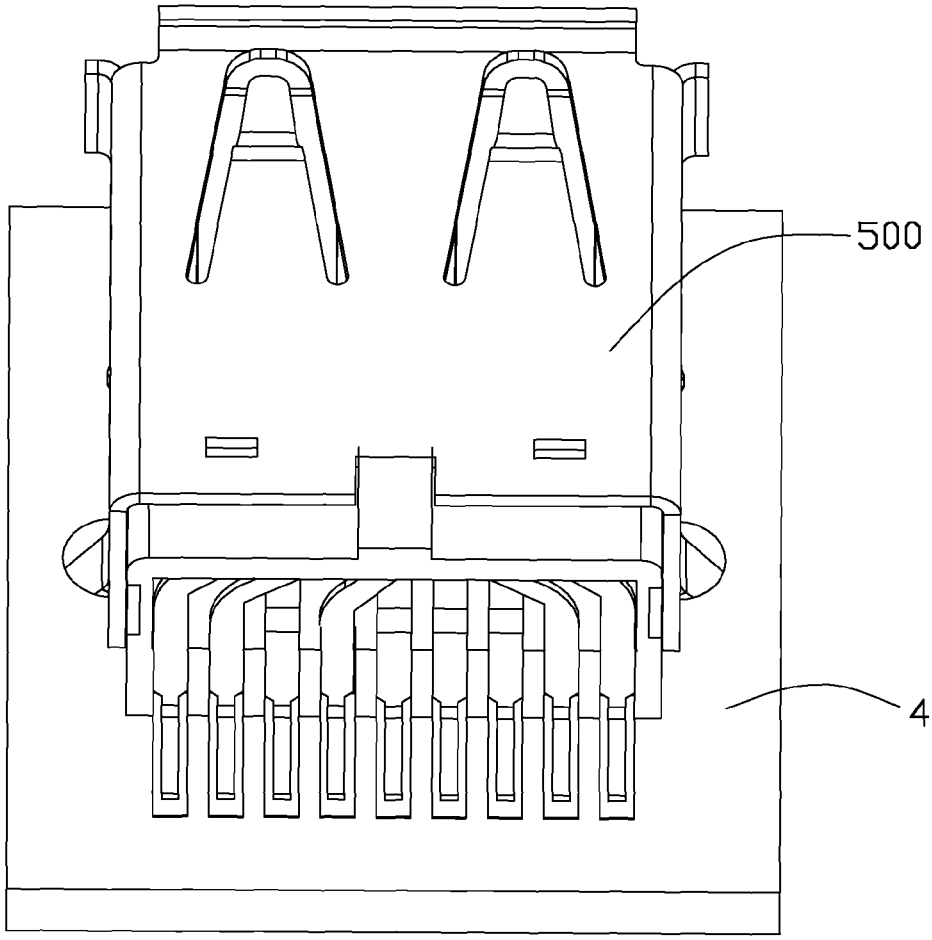
FIG. 43 is a perspective view of an electrical connector mounted on a PCB according to a twenty-third embodiment of the present invention.
Figure 44:
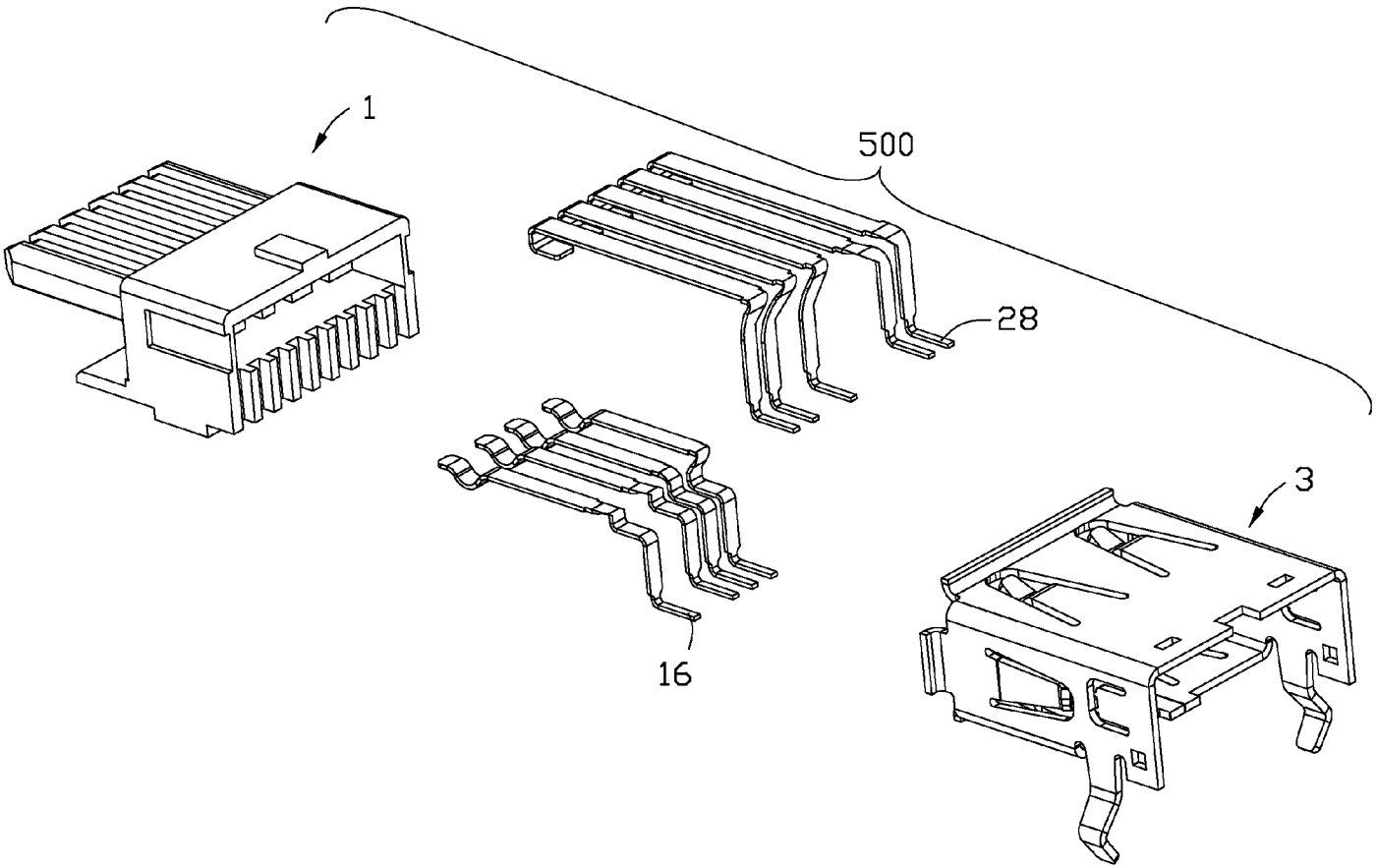
FIG. 44 is an exploded view of the electrical connector shown in FIG. 43 illustrating conductive contacts are separate from additional contacts.
Figure 45:
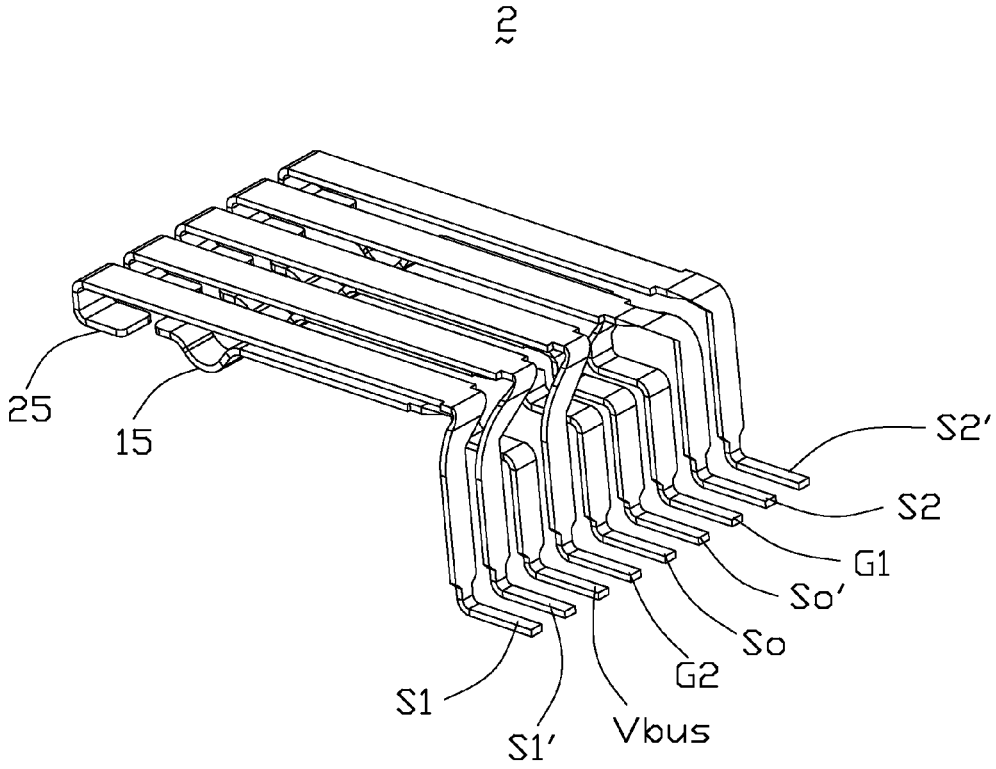
FIG. 45 is a perspective view of the conductive contacts and the additional contacts shown in FIG. 44, but viewed from another aspect.

Referring to FIGS. 43 to 45, a twenty-third embodiment of the present invention discloses an electrical connector 500 which is similar to the electrical connector 300 of the twenty-first embodiment. The difference between them is that the first and the second tail portions Vbus, S0, S0', G1 and S1, S1', G2, S2, S2' are arranged in condition of S1, S1', Vbus, G2, S0, S0', G1, S2, S2' in turn.

Figure 46:
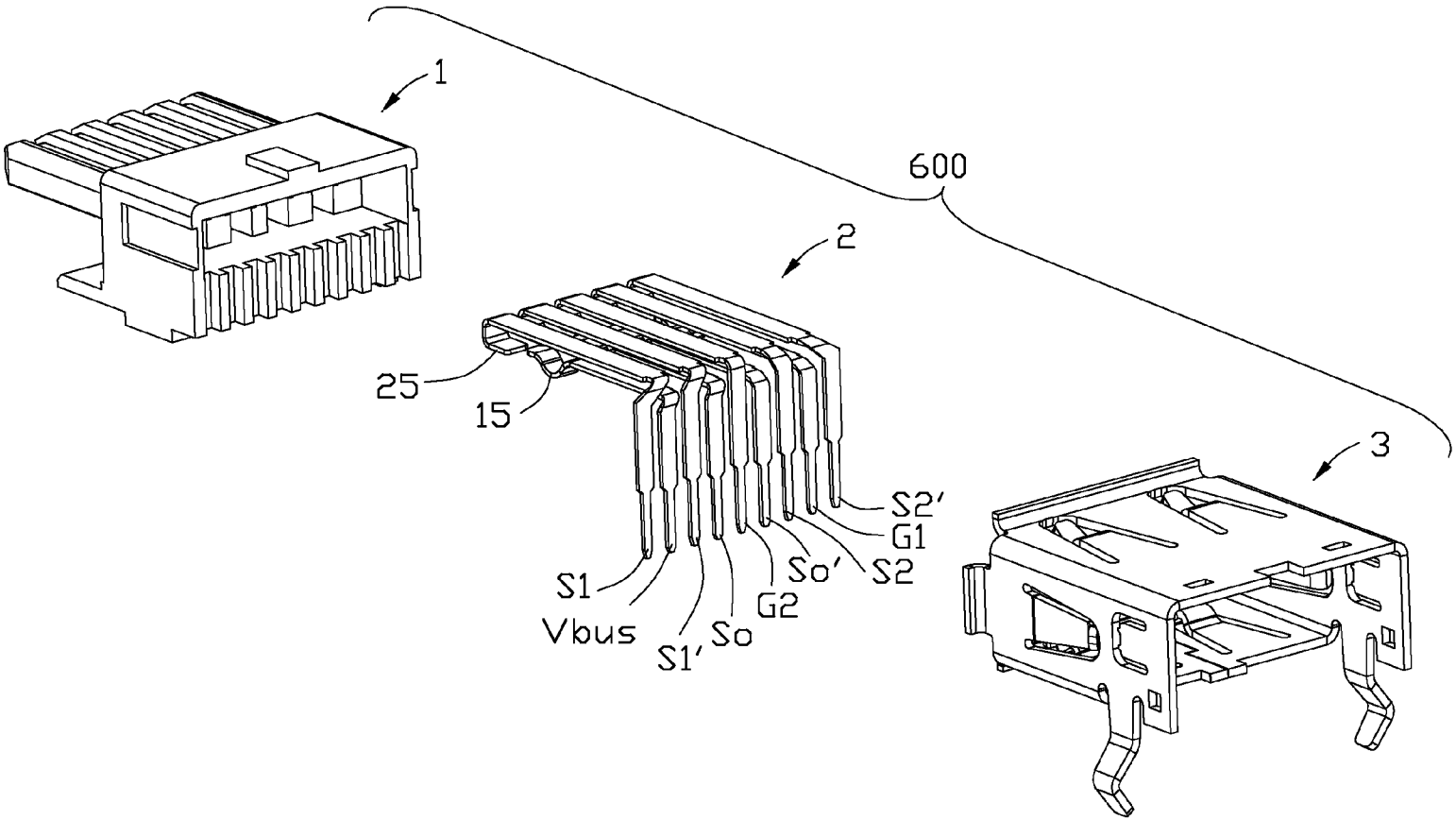
FIG. 46 is a partly perspective view of an electrical connector according to a twenty-fourth embodiment of the present invention.
Figure 47:
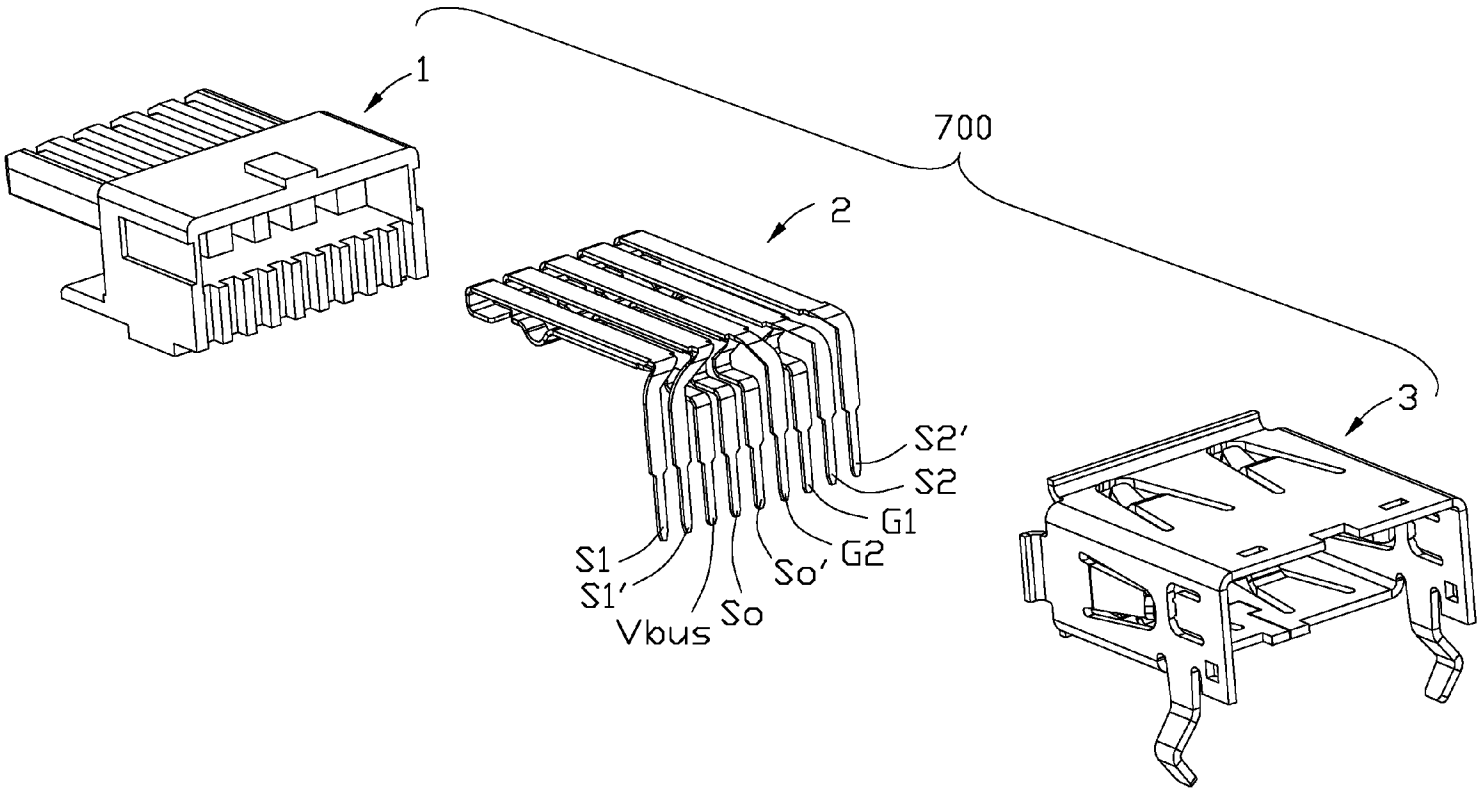
FIG. 47 is a partly perspective view of an electrical connector according to a twenty-fifth embodiment of the present invention.
Figure 48:
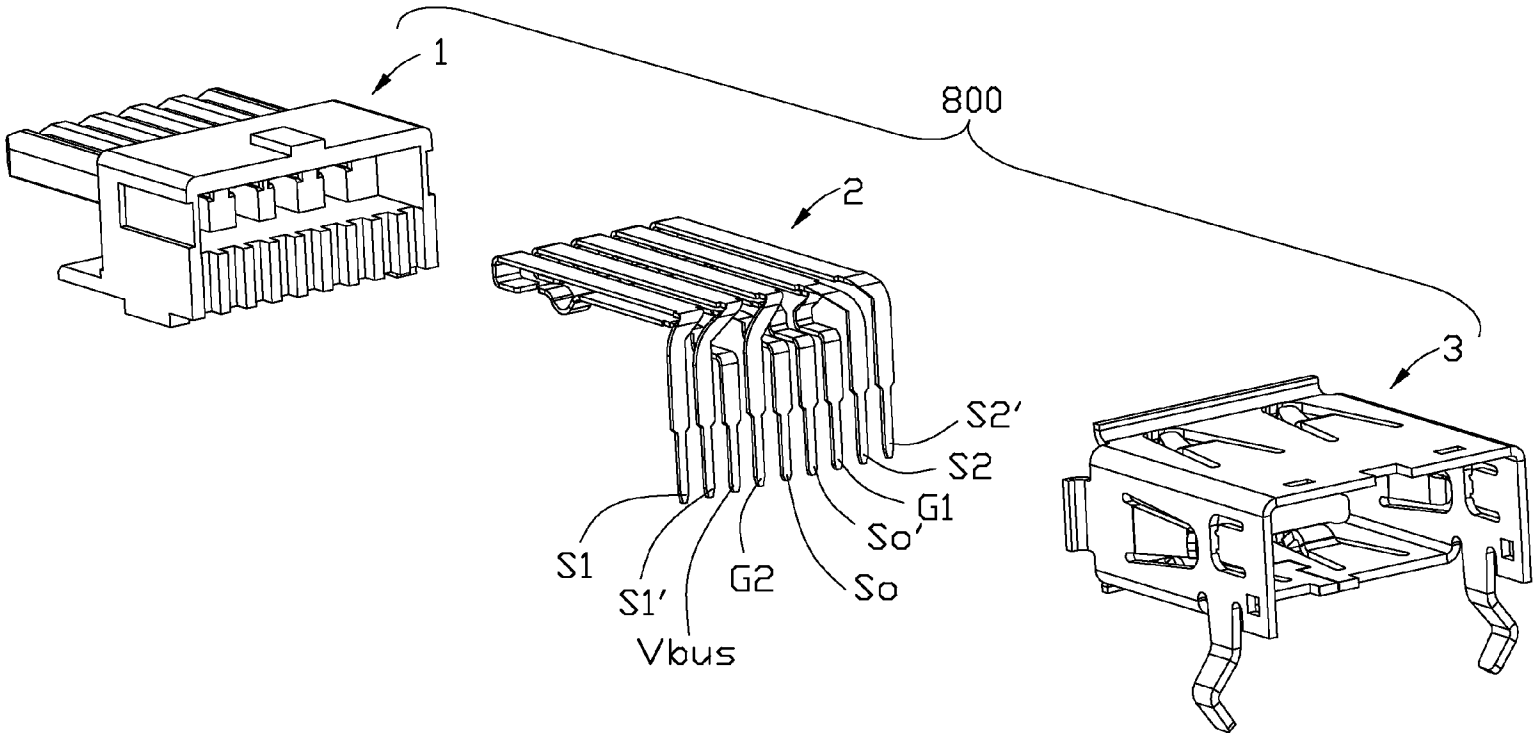
FIG. 48 is a partly perspective view of an electrical connector according to a twenty-sixth embodiment of the present invention.

The first and the second tail portions Vbus, S0, S0', G1 and S1, S1', G2, S2, S2' are of SMT type and can be surface mounted on the PCB 4. Referring to FIGS. 46 to 48, a twenty-fourth, a twenty-fifth and a twenty-sixth embodiments of the present invention disclose electrical connectors 600, 700, 800, respectively. The electrical connector 600 is similar to the electrical connector 300. The difference between them is that the first and the second tail portions Vbus, S0, S0', G1 and S1, S1', G2, S2, S2' of the electrical connector 600 are of through hole type and can be mounted through through holes of a PCB(not shown). The electrical connectors 700 and 800 are much similar to the electrical connectors 400 and 500, respectively, and exist differences the same as the difference between the electrical connector 300 and the electrical connector 600.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector for being mounted on a PCB, defining a receiving space for receiving a plug and comprising:

an insulative housing including a horizontal tongue portion protruding into the receiving space and being parallel to the PCB, the tongue portion defining a mating face, a plurality of depressions defined in a front region of the mating face, and a plurality of passageways defined in a rear region of the mating face and being spaced away from the depressions; and a plurality of contacts held in the tongue portion and comprising a plurality of first and second contacts, the first contacts having elastic first contact portions being movably received in the passageways and protruding beyond the mating face and into the receiving space, first tail portions for being mounted on the PCB, and first connecting portions located between the first contact portions and the first tail portions and extending along the tongue portion, the second contacts having stiff second contact portions received in the depressions and essentially located in front of the first contact portion and exposed to the receiving space, second tail portions for being mounted on the PCB, and second connecting portions located between the second contact portions and the second tail portions and being parallel to the first connecting portions;

wherein the tongue portions comprises a plurality of ribs in condition that each of the depressions is formed between the adjacent two ribs, the ribs extending beyond the first contact portions;

wherein the first and second tail portions are perpendicular to the first and second connecting portions to be mounted through holes of the PCB, the first tail portions and the second tail portions being arranged in front, middle and rear transverse rows along a front-to-back direction;

wherein the first contacts include a first pair of differential contacts, and a first grounding contact and a power contact located at two sides of the first pair of differential contacts, the second contacts include a second pair of differential contacts, a third pair of differential contacts, and a second grounding contact located between the second and third pair of differential contacts, the tail portions of the second pair of differential contacts, the first pair of differential contacts, and the third pair of differential contacts are arranged in a sequence along a transverse direction perpendicular to said front-to-back direction, under a condition that crosstalk between the first and second pairs of differential contacts is reduced by the power contact and the second grounding contact, and crosstalk between the first and third pairs of differential contacts is reduced by the first and second grounding contacts; wherein a total amount of both said first contacts and said second contacts are nine wherein at least the one of the first tail portion of said power contact, the first tail portion of said first grounding contact and the second tail portion of said second grounding contact is located in the middle transverse row; wherein both the first tail portions of said first contacts and the second tail portions of the second contacts are essentially arranged symmetrically with regard to the second tail portion of the second grounding contact in said transverse direction while asymmetrically in the front-to-back direction.

2. The electrical connector as claimed in claim 1, wherein the depressions extend forwardly through a front edge of the tongue portion, and the ribs extend forwardly to the front edge of the tongue portion; wherein.

3. The electrical connector as claimed in claim 1, wherein the second contacts further have bending portions connecting the second contact portions and the second connecting portions, the second contact portions and the second connecting portions are parallel to each other and located on different levels along the height direction of the tongue portion.

4. The electrical connector as claimed in claim 3, wherein the tongue portion defines a top face opposite to the mating face, a plurality of slots defined in the top face for receiving the connecting portions, and a plurality of recesses recessed backwardly from a front edge of the tongue portion and communicating with the slots and the depressions respectively for receiving the corresponding bending portions so that said bending portions are protectively located behind the front edge.

5. An electrical receptacle for insertion of a compatible plug, comprising:

an insulative housing comprising a base portion, and a tongue portion protruding forwardly beyond the base portion and being parallel to the PCB, the tongue portion defining a plurality of ribs formed on one side thereof and being adjacent to a front edge thereof, a plurality of depressions each formed between an adjacent pair of ribs, and a plurality of passageways formed on the side of the tongue portion and recessed from a mating surface thereof;

a metal shell attached to the insulative housing and cooperating with the tongue portion to define a receiving space for receiving the plug; and a plurality of contacts comprising first contacts having elastic first contact portions being movably received in the passageways and protruding beyond the mating face for mating with the plug, and second contacts having stiff second contact portions received in the depressions, each second contact portion disposed between the adjacent pair of ribs and having a planar outer surface exposed to the receiving space for mating with the plug;

wherein the ribs protrude beyond the outer surfaces of the second contact portions for filling in a gap between the tongue portion and a tongue plate of the plug when the plug is inserted into the receptacle;

wherein the ribs extend forwardly to the front edge of the tongue portion, and the depressions extend forwardly through a front edge of the tongue portion, each of the rib define a side surface being coplanar with the mating surface of the tongue portion;

wherein the first contacts have first tail portions for being mounted on a PCB, and first connecting portions extending along the tongue portion and being located between the first contact portions and the first tail portions, the second contacts having second tail portions for being mounted on the PCB, and second connecting portions located between the second contact portions and the second tail portions and being parallel to the first connecting portions in a height direction of the tongue portion;

wherein the first and second tail portions are parallel to the tongue portion and arranged in only a single row along a transverse direction to be mounted onto a surface of the PCB directly, the first contacts includes a first pair of differential contacts, and a first grounding contact and a power contact located at two sides of the first pair of differential contacts, the second contacts includes a second pair of differential contacts, a third pair of differential contacts, and a second grounding contact located between the second and third pair of differential contacts;

wherein the tail portion of the power contact is arranged between the tail portions of the second pair of differential contacts, the tail portion of the second grounding contact is arranged between the tail portions of the first pair of differential contacts, the tail portion of the first grounding contact is arranged between the tail portions of the second pair of differential contacts.

6. The electrical connector as claimed in claim 5, wherein the first and second tail portions are perpendicular to the tongue portion and are arranged in two rows along a front-to-back direction to be mounted through holes of the PCB.

7. An electrical connector assembly comprising:

an insulative housing defining a mating tongue having a mating face and an opposite face thereof;

a metallic shell attached to the housing and cooperating with the mating tongue to define a mating port;

a first set of contacts having a first differential pair of signal contacts and a power contact and a first grounding contact at two opposite sides of the first differential pair of signal contacts, contact sections of said first set of contacts being located on the mating face in a first position along a front-to-back direction;

a second set of contacts having second and third differential pairs of signal contacts and a a second grounding contact therebetween, contact sections of said second set of contacts being located on the mating face in a second position along said front-to-back direction in front of said first position;

tails of the first set of contacts and those of the second set of contacts being arranged in front, middle and rear transverse rows, respectively; wherein the tails of the second differential pair of signal contacts, those of the first differential pair of signal contacts, and those of the third differential pair of signal contacts are arranged in a sequence along a transverse direction perpendicular to said front-to-back direction, under a condition that crosstalk between the second differential pair of contacts and the first differential contacts is reduced by the power contact and the second grounding contact, and crosstalk between the third differential pair of contacts and the first differential pair of contacts is reduced by the first grounding contact and the second grounding contact; wherein a total amount of both said first contacts and said second contacts are nine wherein at least one of the first tail portion of said power contact, the first tail portion of said first grounding contact and the second tail portion of said second grounding contact is located in the middle transverse row; wherein both the first tail portions of said first contacts and the second tail portions of the second contacts are essentially arranged symmetrically with regard to the second tail portion of the second grounding contact in said transverse direction while asymmetrically in the front-to-back direction.

8. The electrical connector assembly as claimed in claim 7, wherein a distance between the first differential pair of contacts and either the power contact or the first grounding contact, is larger than that between the second grounding contact and either one of said second and third differential pair of contacts, along said transverse direction.

9. The electrical connector assembly as claimed in claim 7, wherein the tails of said first and second sets of contacts arranged in said sequence along said transverse direction are one of the second differential pair, the power contact, the other of the second differential pair, one of the first differential pair, the second grounding contact, the other of the first differential pair, one of the third differential pair, the first grounding contact, and the other of the third differential pair.

* * * * *